US006443449B1

(12) United States Patent
Takagi et al.

(10) Patent No.: US 6,443,449 B1
(45) Date of Patent: Sep. 3, 2002

(54) PAPER SHEET DISCHARGE APPARATUS AND PRINTING APPARATUS

(75) Inventors: Kazuhiko Takagi; Hiroyuki Kashima, both of Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/236,466

(22) Filed: Jan. 25, 1999

(30) Foreign Application Priority Data

Jan. 27, 1998 (JP) ..... 10-013686
Feb. 16, 1998 (JP) ..... 10-032471

(51) Int. Cl.[7] ..... B65H 29/00; B65H 39/10

(52) U.S. Cl. ..... 271/279; 271/298; 271/303; 271/305; 271/297

(58) Field of Search ..... 271/298, 279, 271/297, 303, 305, 265.01

(56) References Cited

U.S. PATENT DOCUMENTS

| | | | | |
|---|---|---|---|---|
| 4,203,587 A | | 5/1980 | Kishi et al. | |
| 4,227,683 A | | 10/1980 | Spangler et al. | |
| 4,501,419 A | | 2/1985 | Takahashi et al. | |
| 4,520,263 A | | 5/1985 | Kitamura | |
| 5,141,222 A | | 8/1992 | Sawada et al. | |
| 5,319,216 A | | 6/1994 | Mokuo et al. | |
| 5,328,169 A | | 7/1994 | Mandel | |
| 5,414,503 A | | 5/1995 | Siegel et al. | |
| 5,505,442 A | | 4/1996 | Chang et al. | |
| 5,551,686 A | * | 9/1996 | Sanchez et al. | 271/298 |
| 5,630,578 A | | 5/1997 | Naramore et al. | |
| 5,632,479 A | | 5/1997 | Kubota et al. | |
| 5,810,353 A | * | 9/1998 | Baskette et al. | 271/305 |
| 5,915,690 A | * | 6/1999 | Surya | 271/265.01 |
| 5,963,754 A | | 10/1999 | Itoh et al. | |
| 6,142,469 A | | 11/2000 | Nanbe et al. | |

FOREIGN PATENT DOCUMENTS

| | | |
|---|---|---|
| EP | 0 757 964 A2 | 2/1997 |
| EP | 0 798 255 A2 | 10/1997 |
| JP | A-1-197277 | 8/1989 |
| JP | A--8-259093 | 10/1996 |
| JP | A-9-175714 | 7/1997 |
| JP | A-10-072162 | 3/1998 |
| JP | A-10-152261 | 6/1998 |

OTHER PUBLICATIONS

Patent Application No. 09/253,551, filed Feb. 22, 1999 (102455), "Paper Sheet Discharge Apparatus", Kazuhiko Takagi et al.

Patent Application No. 09/385,035, filed Aug. 30, 1999 (102455.01), "Recording Medium Discharging Apparatus and Image Forming Apparatus Provided Therewith", Eiji Yokota et al.

Patent Application No. 09/283,588, filed Apr. 1, 1999 (103122), "Recording Medium Discharge Apparatus and Image Forming Apparatus Equipped with Recording Medium Discharge Apparatus", Hiroyuki Kashima et al.

* cited by examiner

*Primary Examiner*—Donald P. Walsh
*Assistant Examiner*—Jonathan R Miller
(74) *Attorney, Agent, or Firm*—Oliff & Berridge, PLC

(57) ABSTRACT

A paper sheet discharge apparatus comprises a transport roller for transporting paper sheets discharged from an image-forming apparatus, a plurality of switching flappers for guiding the paper sheets to desired bins, and a plurality of delivery rollers for discharging the paper sheets via the switching flappers to the bins. The paper sheets are reliably stored in the desired bins without decreasing their transport speed by the aid of the transport roller, the switching flappers, and the delivery rollers. The power from a motor is transmitted only to the delivery rollers which are used to discharge the paper sheets while being interlocked with the specified switching flapper. Therefore, it is possible to diminish the load on the motor.

30 Claims, 13 Drawing Sheets

PAPER SHEET DISCHARGE APPARATUS AND PRINTING APPARATUS

BACKGROUND OF THE INVENTION

1. Field of the Invention

The present invention relates to a paper sheet discharge apparatus, in particular, to a paper sheet discharge apparatus for receiving, sorting, and accommodating paper sheets such as print paper sheets discharged from a printing apparatus such as a printer. The present invention also relates to a printing apparatus including such a paper sheet discharge apparatus.

2. Description of the Related Art

The recording medium discharge apparatus has been hitherto known, which is used to receive, sort, and accommodate recording media such as paper sheets discharged from an image-forming apparatus or a printing apparatus such as copying machines, printers and facsimiles.

Such a recording medium discharge apparatus is disclosed, for example, in Japanese Patent Application Laid-Open No. 1-197277, comprising a plurality of bins for storing paper sheets, and a pair of transport rollers for receiving paper sheets discharged from an image-forming apparatus and discharging them to a predetermined discharge position, wherein the plurality of bins are vertically moved upwardly and downwardly to the fixed discharge positions of the pair of transport rollers so that the paper sheets are sorted into those stored in the respective bins. U.S. Pat. No. 5,551,686 (corresponding to Japanese Patent Application Laid-Open No. 8-259093) describes a system comprising a plurality of fixed bins moving belts for transporting paper sheets discharged from an image-forming apparatus, in an alignment direction of the plurality of bins, and gates provided corresponding to the respective bins, for changing the direction of transport of the paper sheets effected by the moving belts so that the paper sheets are guided to the corresponding bins.

However, in recent years, it is further required that the image formation process should be performed at a high speed, in accordance with which it is also required to perform, at a high speed, the process of sorting and accommodating the paper sheets discharged from the image-forming apparatus. In the case of the apparatus in which the plurality of bins are vertically moved upwardly and downwardly to the fixed discharge position of the pair of transport rollers, it takes a long time to vertically move the bins, and it is difficult to contemplate acceleration of the sorting and accommodating process. In the case of the system in which the paper sheets, which are discharged from the image-forming apparatus, are transported by using the moving belts, and the transport direction is changed by using the gate to discharge the paper sheets to the respective bins, it is feared that the rearward end of the paper sheet cannot be discharged reliably to the bin if the resistance between the paper sheet and the bin is large when the paper sheets are fed from the moving belts to the respective bins. Therefore, such a system has a possibility, for example, of being jammed with the paper sheets. Further, in the case of any one of the recording medium discharge apparatus and system, the increase in load exerted on a driving source and the noise generated during operation raise problems when the high speed performance is pursued.

Japanese Patent Application Laid-Open No. 9-175714 discloses a paper sheet discharge apparatus comprising multiple stages of delivery units provided in a united manner to make it possible to distribute paper sheets discharged from a paper sheet-processing unit. The delivery unit includes a tray for accommodating paper sheets, a receiving port for receiving the paper sheets transported from the paper sheet discharge apparatus, a transport means for transporting the paper sheets transported from the receiving port, a discharge port for allowing the paper sheets transported by the transport means to be discharged to the receiving port of the delivery unit, and a guide means for guiding the paper sheets imported from the receiving port to the tray or the discharge port (claim 9 in Japanese Patent Application Laid-Open No. 9-175714). However, unlike the present invention, this patent document does not disclose any structure in which a transport direction-switching unit is provided between transport rollers and each of bins or a discharge roller for discharging paper sheets to each of bins or a tray.

SUMMARY OF THE INVENTION

The present invention has been made in order to solve the problems as described above, an object of which is to provide a paper sheet discharge apparatus which makes it possible to sort and accommodate paper sheets such as those discharged from a printing, reliably at a high speed, and provide a printing apparatus including the same. Another object of the present invention is to provide a paper sheet discharge apparatus which makes it possible to reduce the load on a driving source and the generation of noise, and to provide a printing apparatus including the same.

According to a first aspect of the present invention, there is provided a paper sheet discharge apparatus for sorting and discharging paper sheets discharged from a printing apparatus, comprising:

- a casing formed with an introducing section for receiving the paper sheets;
- a plurality of bins attached to the casing, for storing the sorted paper sheets respectively;
- a plurality of delivery rollers for discharging, to the respective bins, the paper sheets introduced from the introducing section, each of the delivery rollers being provided in the casing corresponding to each of the bins;
- a transport unit for transporting, to the plurality of delivery rollers, the paper sheets introduced from the introducing section; and
- a plurality of transport direction-switching units for switching a transport direction of the paper sheets introduced from the introducing section to sort the paper sheets into the plurality of bins, each of the transport direction-switching units being provided between the transport unit and the respective delivery roller.

According to the paper sheet discharge apparatus of the present invention, it is unnecessary to move the bin by using a vertical movement mechanism or the like even when a specified bin to be used for storing the paper sheets is changed to another bin. Each of the transport direction-switching units is provided between the transport unit and the delivery rollers associated with the predetermined bin to which the paper sheets should be discharged. Accordingly, the paper sheets, of which the transport direction is switched by the transport direction-switching unit, are reliably discharged to the corresponding bin by the aid of the delivery roller. Therefore, the paper sheets, on which predetermined images are formed, can be sorted and accommodated reliably at a high speed.

The paper sheet discharge apparatus according to the present invention may further comprise a power-transmitting unit for transmitting power to the respective delivery rollers; and a selective transmitting unit for selectively transmitting power to only a specified delivery roller which is used to discharge the paper sheets, of the plurality of delivery rollers. The selective transmitting unit may comprise a mode-switching unit for making changeover into any one of power transmission and cutoff modes with respect to respective delivery rollers, wherein the mode-switching unit is operated while being interlocked with a switching action of the transport direction-switching unit.

According to a second aspect of the present invention, there is provided a paper sheet discharge apparatus for sorting and discharging paper sheets discharged from a printing apparatus, comprising:

an introducing section for introducing the paper sheets discharged from the printing apparatus;

a plurality of discharge means for discharging the introduced paper sheets;

a plurality of storing units provided corresponding to the respective discharge means, for storing the paper sheets discharged by the discharge means;

a transport means for transporting, to the respective discharge means, the paper sheets introduced from the introducing section; and a switching means for switching a transport direction for transporting the paper sheets received from the introducing section to a specified discharge means.

According to the paper sheet discharge apparatus as defined in the second aspect, the printed paper sheets are received through the introducing section (for example, an introducing passage 21), and they are transported to the specified discharge means (for example, delivery rollers 22) of the plurality of discharge means by the aid of the transport means (for example, transport rollers 24) and the switching means (for example, switching flappers 25). The transported paper sheets are discharged by the discharge means to the storing unit which is provided corresponding to the discharge means. Therefore, even when the storing unit for storing the paper sheets is changed, it is unnecessary to move the storing unit by using a vertical movement mechanism or the like, in the same manner as in the paper sheet discharge apparatus according to the first aspect. The paper sheets, the transport direction of which is switched by the switching means, are reliably discharged to the corresponding storing unit by the aid of the discharge means. Therefore, the paper sheets, on which predetermined images are formed, can be sorted and accommodated reliably at a high speed.

In the paper sheet discharge apparatus according to the second aspect, the respective storing units may be provided detachably. When the respective storing units are detachably attached, for example, the respective storing units are installed beforehand in ordinary use, and they can be used for the sorting process. When it is intended to stack a large number of paper sheets, an arbitrary storing unit is removed or arbitrary storing units are removed so that the space, which is obtained by removing the storing unit or the storing units, can be used as a space for storing the paper sheets. Thus, the space can be used as a stacker for storing a larger amount of paper sheets.

The paper sheet discharge apparatus according to the second aspect may further comprise a storage amount-detecting means for detecting the fact that the paper sheets to be stored in the respective storing units have a predetermined amount in the concerning storing unit; and a discharge control means (for example, a discharge control program) for switching the switching means so that the paper sheets are transported to another storing unit for which it is not detected that the paper sheets have the predetermined amount, when the storage amount-detecting means detects the fact that the paper sheets stored in the specified storing unit have the predetermined amount in a state in which the paper sheets received from the introducing section are transported to the specified discharge means by the aid of the transport means and the switching means and they are stored in the specified storing unit. According to the apparatus constructed as described above, when the paper sheets stored in the specified storing unit have the predetermined amount, the storage amount-detecting means detects the fact that the paper sheets have the predetermined amount. Subsequently, the discharge control means switches the switching means so that the paper sheets are transported, not to the storing unit in which the paper sheets have the predetermined amount, but to the storing unit for which it is not detected that the paper sheets have the predetermined amount, i.e., the storing unit in which the paper sheets do not arrive at the predetermined amount. Accordingly, when the specified storing unit, to which the paper sheets are transported, stores the predetermined amount of paper sheets, the paper sheets are successively transported in an automatic manner to the storing unit in which the paper sheets do not arrive at the predetermined amount.

The paper sheet discharge apparatus according to the second aspect may comprise the plurality of storing units arranged in an aligned state, and it may further comprise a sequential discharge control means (for example, a discharge control program) for switching the switching means so that the paper sheets are successively transported in an order of the storing units aligned in their alignment direction. The sequential discharge control means is operated as follows. That is, when the specified storing unit, to which the paper sheets are transported, have the predetermined amount of paper sheets, the paper sheets are successively transported to another storing unit in the order of the storing units aligned in the alignment direction, and the paper sheets are successively stored in the respective storing units. Accordingly, the paper sheets to be stored are not stored randomly in the plurality of storing units, but they can be stored in a regular state. The paper sheet discharge apparatus according to the second aspect is preferably used in combination with the printing apparatus such as an image-forming apparatus and a printer. The use of the paper sheet discharge apparatus in combination with the printing apparatus makes it possible to smoothly sort and accommodate, at a high speed, the paper sheets discharged from the image-forming apparatus.

According to a third aspect of the present invention, there is provided a paper sheet discharge apparatus for sorting and discharging paper sheets discharged from a printing apparatus, comprising:

an introducing section for receiving the printed paper sheets;

a plurality of discharge means for discharging the received paper sheets;

a plurality of storing units provided corresponding to the respective discharge means, for storing the paper sheets discharged by the discharge means;

a transport means for transporting, to the respective discharge means, the paper sheets received from the introducing section;

a transport direction-switching means for switching a transport direction for transporting the paper sheets received from the introducing section to a specified discharge means;

a power-transmitting means for transmitting power from a driving source to the respective discharge means; and a selective transmitting means for allowing the power from the driving source to be selectively transmitted to only the specified discharge means which is used to discharge the paper sheets, of the plurality of discharge means.

According to the paper sheet discharge apparatus as defined in the third aspect of the present invention, the printed paper sheets are received through the introducing section, and they are transported to the specified discharge means of the plurality of discharge means by the aid of the transport means and the transport direction-switching means. The transported paper sheets are discharged by the discharge means to the storing unit which is provided corresponding to the discharge means. The power-transmitting means (for example, a roller-driving gear array 101) for transmitting the power from the driving source to the respective discharge means is operated as follows. That is, all of the discharge means are not driven by commonly transmitting the power from the driving source to the respective discharge means. Instead, the selective transmitting means (for example, a swinging mechanism 118) is successfully used to selectively transmit the power from the driving source to only the specified discharge means which is used to discharge the paper sheets, of the plurality of discharge means. Accordingly, it is possible to diminish the load on the driving source, and it is possible to reduce the driving sound during the operation, as compared with the case in which all of the discharge means are always driven.

In the paper sheet discharge apparatus according to the third aspect of the present invention, the selective transmitting means may comprise a mode-switching means (for example, a delivery roller gear 99) for making changeover into any one of transmission and cutoff modes of power from the driving source to the respective discharge means, wherein the mode-switching means is operated while being interlocked with a switching action of the transport direction-switching means. According to the apparatus constructed as described above, the selective transmitting means transmits the power only to the specified discharge means which is used to discharge the paper sheets, of the plurality of discharge means, in accordance with the operation of the mode-switching means, and the power transmission is cut off for the other discharge means which are not used to discharge the paper sheets. That is, the simple system to achieve the transmission or the cutoff of the power makes it possible to selectively transmit the power to only the specified discharge means which is used to discharge the paper sheets, of the plurality of discharge means. Further, the mode-switching means is operated while being interlocked with the switching action of the transport direction-switching means. Therefore, it is unnecessary to provide any special apparatus system for switching the mode-switching means. Thus, the power from the driving source can be selectively transmitted in a reliable manner to the discharge means which is used to discharge the paper sheets, by using the simple and convenient system.

In the paper sheet discharge apparatus according to the third aspect of the present invention, the respective storing units may be provided detachably. When the respective storing units are detachably attached, for example, the respective storing units are installed beforehand in an ordinary state, and they can be used for the sorting process. When it is intended to stack a large number of paper sheets, an arbitrary storing unit is removed or arbitrary storing units are removed so that the space, which is obtained by removing the storing unit or the storing units, can be used as a space for storing the paper sheets. Thus, the space can be used as a stacker for storing a larger amount of paper sheets.

In the case of the use as the stacker, the storing unit is removed, or the storing units are removed. For this reason, the discharge means corresponding to the removed storing unit occasionally makes contact with the stacked paper sheets. In such a situation, if all of the discharge means are always driven, then the discharge means contacting with the stacked paper sheets is also driven, and hence the load on the driving source is increased. Further, it is feared that the paper sheets contacting with the driven discharge means may be damaged due to the driving operation of the discharge means. On the contrary, in the present invention, the selective transmitting means is used to drive only the specified discharge means which is used to discharge the paper sheets. Therefore, the discharge means contacting with the stacked paper sheets is never driven. Therefore, the load on the driving source is not increased, which would be otherwise increased by the driving operation of the discharge means contacting with the paper sheets. Further, the paper sheets contacting with the discharge means are not damaged as well.

In the paper sheet discharge apparatus according to the third aspect of the present invention, the power-transmitting means may transmit the power from the driving source to the transport means, and the selective transmitting means may selectively transmit, to the discharge means, the power transmitted to the transport means. According to the apparatus constructed as described above, the power from the driving source is transmitted to the transport means by the aid of the power-transmitting means. The power transmitted to the transport means is selectively transmitted to the discharge means by the aid of the selective transmitting means. Therefore, the one driving source can be used to drive the transport means and the discharge means. The paper sheet discharge apparatus may comprise a control means for controlling the selective transmitting means to drive only the specified discharge means which is used to discharge the paper sheets. The control means as described above controls the selective transmitting means to drive only the specified discharge means which is used to discharge the paper sheets.

According to a fourth aspect of the present invention, there is provided a printing apparatus comprising:

a discharge unit for discharging printed paper sheets;

a receiving unit for receiving the paper sheets discharged from the discharge unit;

a received amount sensor for detecting the fact that the paper sheets received by the receiving unit have a predetermined amount;

a paper sheet discharge apparatus for sorting and discharging the paper sheets discharged from the discharge unit, the discharge apparatus including:

a casing connected to the discharge unit and formed with an introducing section for receiving the paper sheets discharged from the discharge unit;

a plurality of bins attached to the casing, for storing the sorted paper sheets respectively;

a plurality of delivery rollers for discharging, to the respective bins, the paper sheets introduced from the introducing section, each of the delivery rollers being provided in the casing corresponding to each of the bins;

a transport unit for transporting, to the plurality of delivery rollers, the paper sheets introduced from the introducing section; and a plurality of first switching units for switching a transport direction to sort the paper sheets introduced from the introducing section into the plurality of bins, each of the transport direction-switching units being provided between the bin and the one of delivery rollers; and a second switching unit for switching a discharge direction of the paper sheets to a direction to the introducing section when the received amount sensor detects the fact that the paper sheets stored in the receiving unit have the predetermined amount.

According to the printing apparatus of the present invention, each of the first switching units of the paper sheet discharge apparatus is provided between one of the bins and the delivery rollers associated with the bin. Accordingly, the paper sheets, of which the transport direction is switched by the switching unit, are reliably discharged to the associated bin by the aid of the associated delivery roller. Therefore, the paper sheets, on which predetermined images are formed, can be sorted and accommodated reliably at a high speed. When the paper sheets received by the receiving unit have the predetermined amount during the discharge of the printed paper sheets to the receiving unit, and the received amount sensor detects the fact that the paper sheets arrive at the predetermined amount, then the second switching unit (for example, a selector flapper 12) is operated to switch the discharge direction of the paper sheets into the direction to the introducing section of the paper sheet discharge apparatus. Accordingly, when the receiving unit of the printing apparatus have the predetermined amount of paper sheets, the paper sheets can be stored in the storing unit of the paper sheet discharge apparatus.

The second switching unit may be provided in the discharge apparatus, or in the main printing apparatus body. The provision of the second switching unit in the paper sheet discharge apparatus makes it possible to allow all of the members for determining the discharge direction of the paper sheets to be arranged on the side of the paper sheet discharge apparatus. The provision of the second switching unit in the discharge apparatus makes it possible to simplify the system arrangement on the side of the paper sheet discharge apparatus.

The printing apparatus according to the present invention may further comprise a driving source; a power-transmitting unit for transmitting power to the respective delivery rollers; and a selective transmitting unit for selectively transmitting power to only a specified delivery roller which is used to discharge the paper sheets, of the plurality of delivery rollers. The selective transmitting unit may comprise a mode-switching unit for making changeover into any one of power transmission and cutoff modes with respect to respective discharge means, wherein the mode-switching unit is operated while being interlocked with a switching action of the first switching unit.

BRIEF DESCRIPTION OP THE DRAWINGS

FIGS. 13 A and B show a flow chart illustrating the process in the stacker mode.

Figure 3:
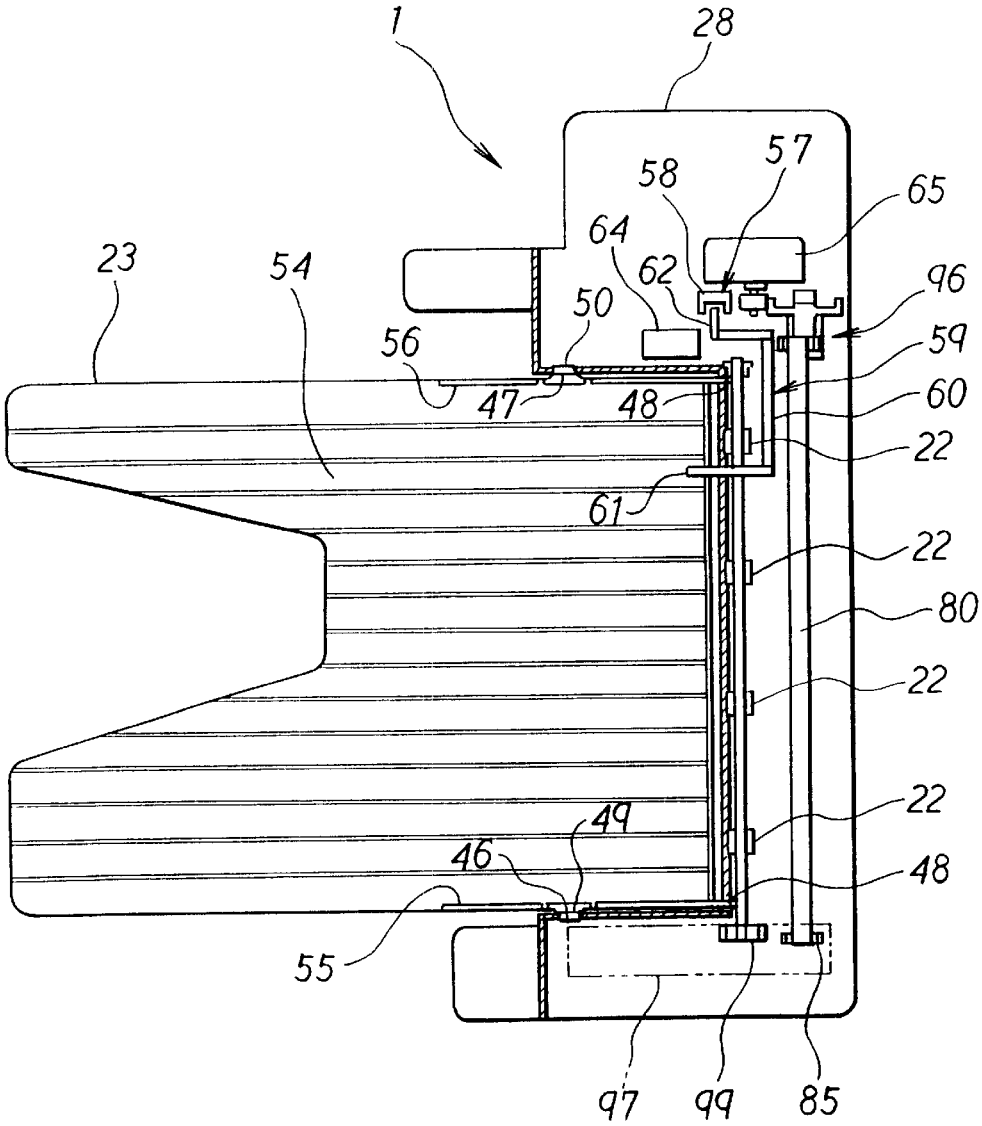
FIG. 3 shows a cross-sectional top view of main components in which a bin is viewed from an upper position.
Figure 14:
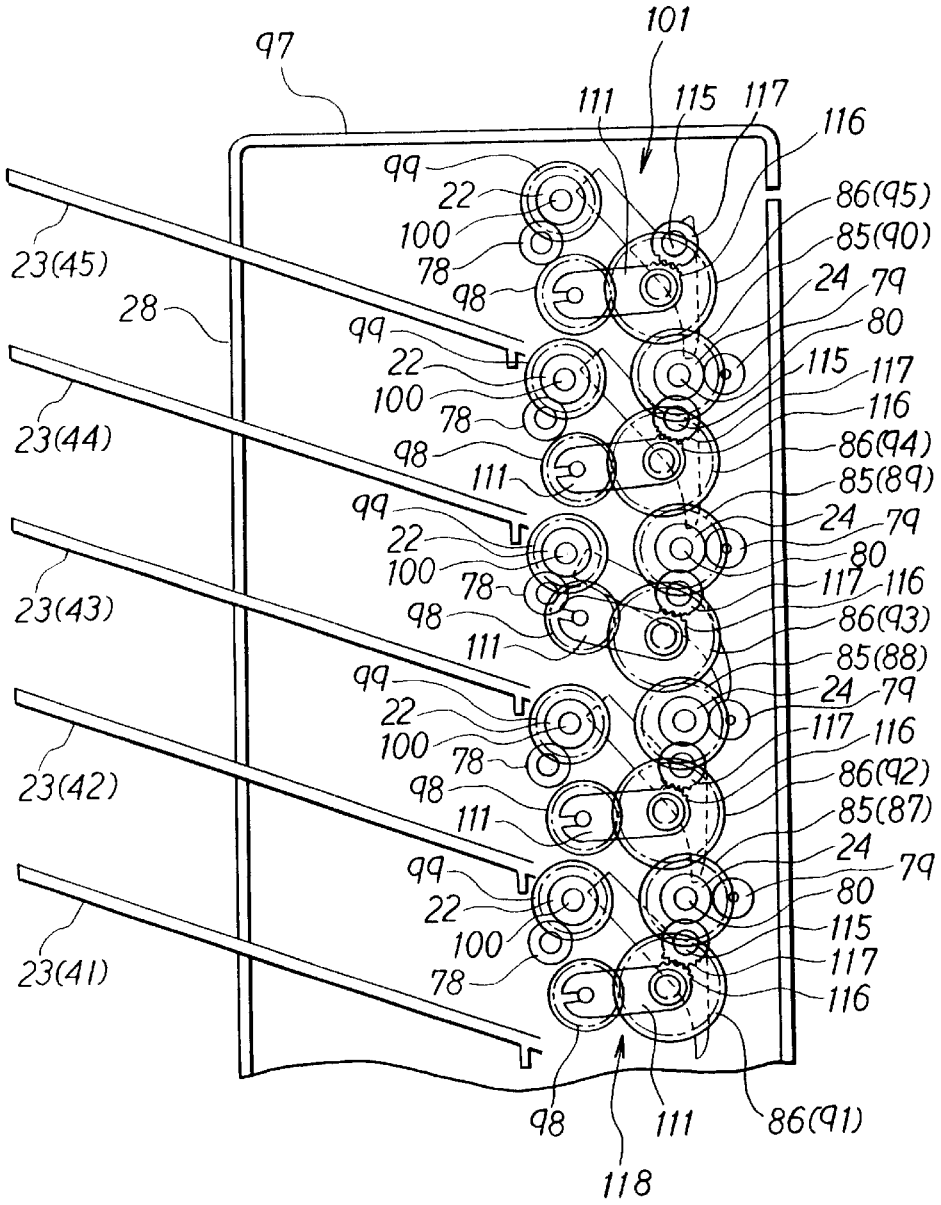

FIG. 14 shows a cross-sectional side view of main components as viewed from a side of a gear box shown in FIG. 3.

Figure 15:
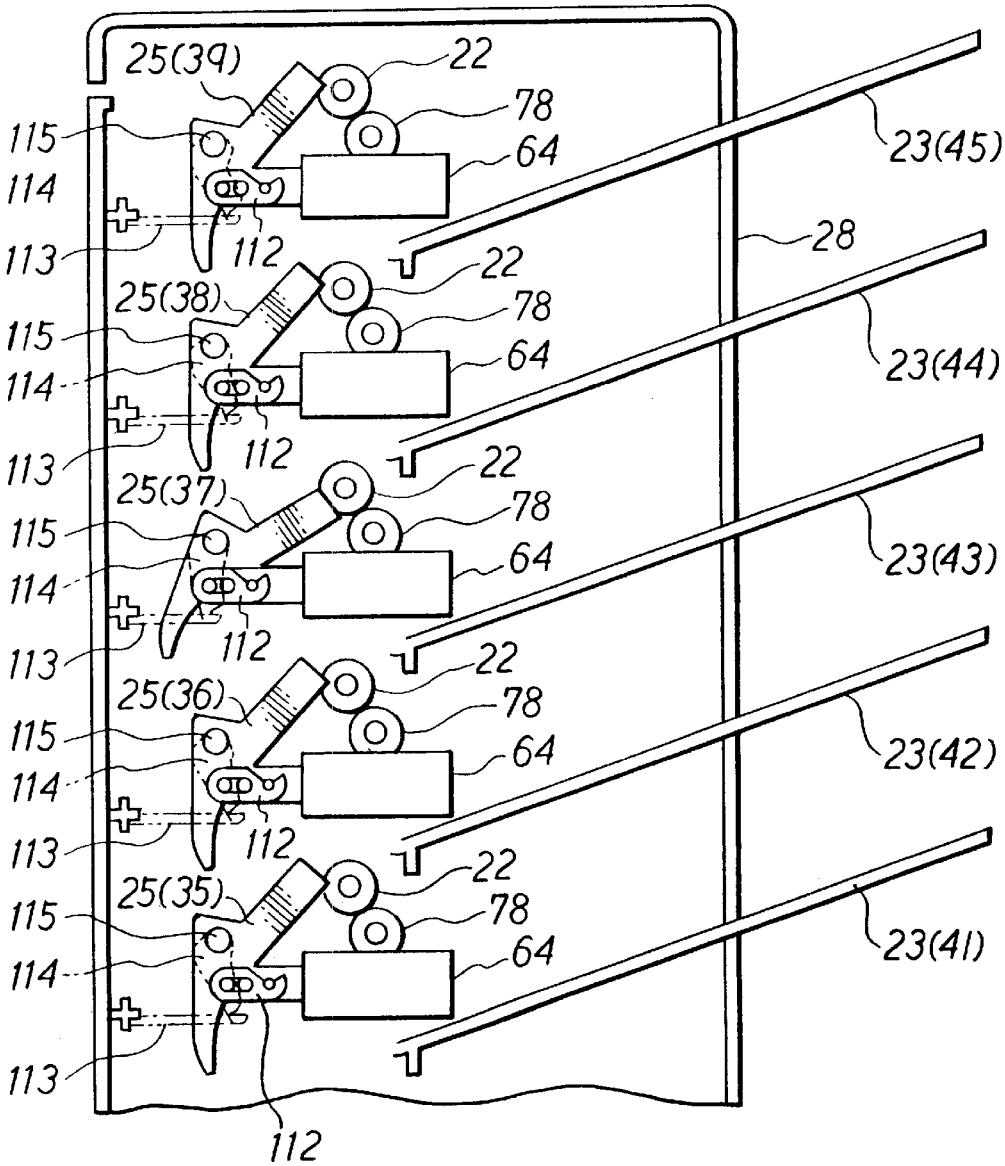

FIG. 15 shows a cross-sectional side view of main components as viewed from a side of a solenoid shown in FIG. 3.

DESCRIPTION OP THE PREFERRED EMBODIMENTS

Figure 1:
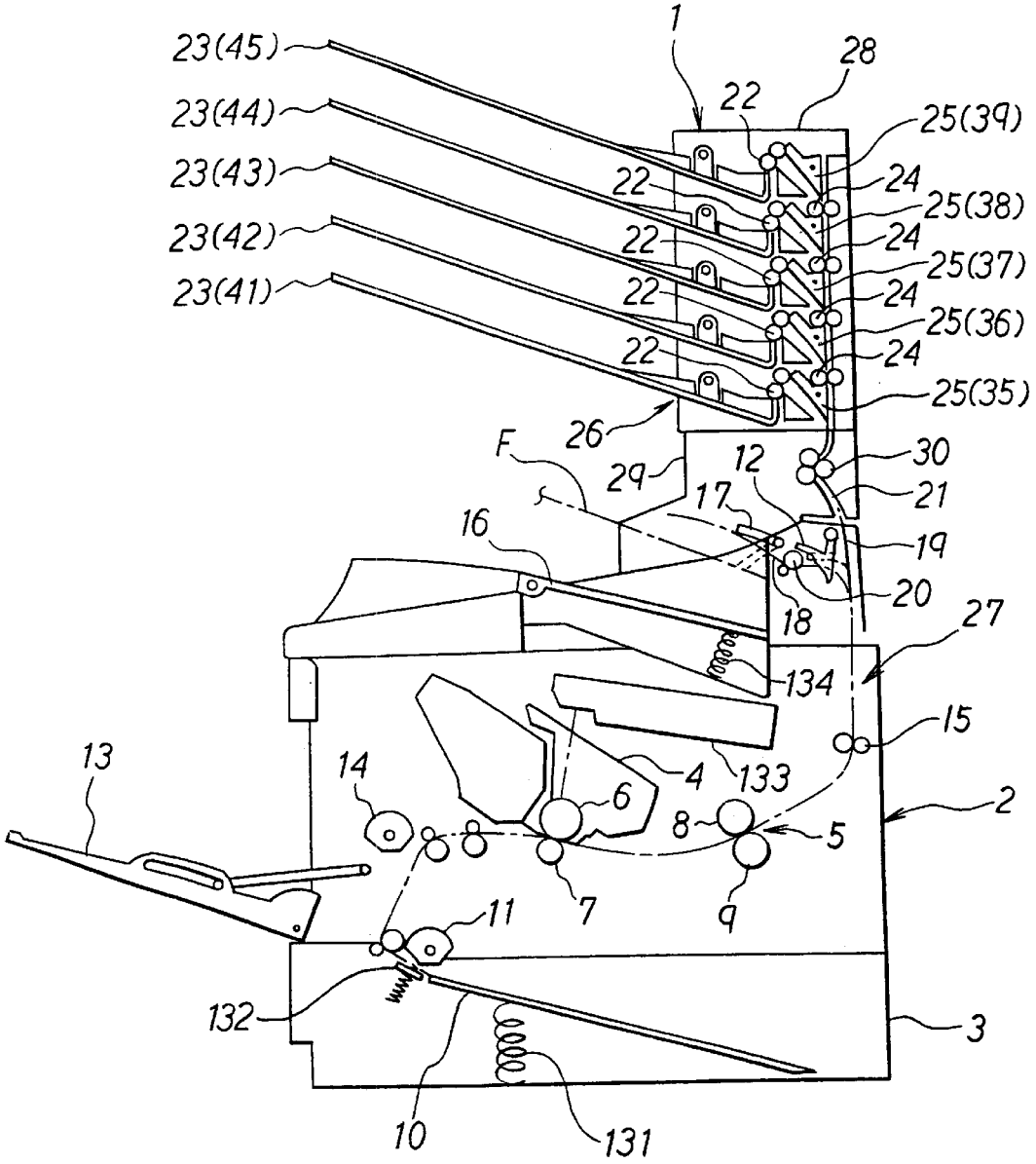
FIG. 1 shows a cross-sectional aide view of main components illustrating an embodiment of a laser printer as an image-forming apparatus (printing apparatus) provided with the paper sheet discharge apparatus of the present invention.

FIG. 1 shows a cross-sectional side view of main components illustrating an embodiment of a laser printer 2 as an image-forming apparatus provided with a paper sheet discharge apparatus 1 of the present invention.

With reference to FIG. 1, a paper sheet cassette 3 for accommodating paper sheets as recording media in a stacked state is provided under the laser printer 2. The paper sheet cassette 3 is provided with a receiving plate for receiving the paper sheets in the stacked manner and a spring 131 for urging the receiving plate 10 upwardly. A transport roller 11 and a friction separator pad 132, which are used to separate and feed, one by one, the paper sheets stacked on the receiving plate 10, are provided in the vicinity of one end of the receiving plate 10. The paper sheets, which are stacked in the cassette 3, are transported toward an image-forming unit 4 as described later on.

The image-forming unit 4 is arranged downstream of the paper sheet cassette 3 in the transport direction of the paper sheet. The image-forming unit 4 is provided in order that an electrostatic latent image, which is formed by exposing a photosensitive member-equipped drum after charging, with the light in accordance with image information by using a laser scanner 133, is developed with toner to form a toner image. A fixing unit 5 for fixing the toner transferred to the paper sheet is arranged downstream of the image-forming unit 4. The image-forming unit 4 comprises the photosensitive member-equipped drum 6, an unillustrated developing unit, an unillustrated charging unit, and other components. After charging the photosensitive member-equipped drum 6, the electrostatic latent image, which is formed by exposure and scanning with the laser scanner 133, is developed with the toner to form the toner image. A transfer roller 7 for transferring the toner image formed on the photosensitive member-equipped drum 6 onto the paper sheet is provided under the photosensitive member-equipped drum 6. On the other hand, the fixing unit 5 comprises a heating roller 8 and a pressing roller 9 which is arranged in opposition to the heating roller 8. The paper sheet, which is transported from the cassette 3, is fed to the space between the photosensitive member-equipped drum 6 and the transfer roller 7 or the image-forming unit 4 to transfer the toner image thereon. After that, the paper sheet is fed to the space between the heating roller 8 and the pressing roller 9 of the fixing unit 5 to fix the transferred toner image. The paper sheet is then fed to the discharge rollers 15 described below.

A discharge unit 27 for discharging the paper sheets is provided downstream of the fixing unit 5 in the paper sheet transport direction. The discharge unit 27 comprises discharge rollers 15 for discharging the paper sheets, a discharge tray-side guide passage 19 for discharging the paper sheets discharged from the discharge rollers 15 toward a discharge tray 16 described below, and an introducing passage-side guide passage 19 for discharging the paper sheets toward an introducing section of the paper sheet discharge apparatus 1 described later on.

The discharge tray 16, which serves as a receiving section for receiving the paper sheets discharged by the discharge rollers 15 and stacking the paper sheets in a stacked manner, is provided on the downstream side of the discharge tray-side guide passage 18. The discharge tray 16 is provided in a recess formed at an upper portion of the laser printer 2. A downstream end of the discharge tray 16 is rotatably supported, and an upstream end thereof is urged upwardly by a spring 134. When the paper sheets are stacked, the discharge tray 16 is gradually rotated downwardly as its weight is increased. Accordingly, it is possible to stack a large amount of paper sheets in an aligned state. A discharge tray level sensor 17, which serves as a received amount-detecting means for detecting the fact that the capacity of the discharge tray 16 is filled with the stacked paper sheets, i.e., the full level, is attached to a downstream upper portion of the discharge tray 16. The discharge tray level sensor 17 has a detecting tab which is rotatably movable. The discharge tray level sensor 17 detects the full level if the paper sheets are stacked up to a position indicated by a phantom line F, the detecting tab abuts against the upper surface of the paper sheet, and the detecting tab ceases to make rotation downwardly beyond the position indicated by the phantom line.

An uncurling roller 20 for removing warpage of the paper sheet is provided in the discharge tray-side guide passage 18. The laser printer 2 is provided with a manual feed tray 13 and a transport roller 14 for transporting the paper sheet placed on the manual feed tray 13.

Figure 2:
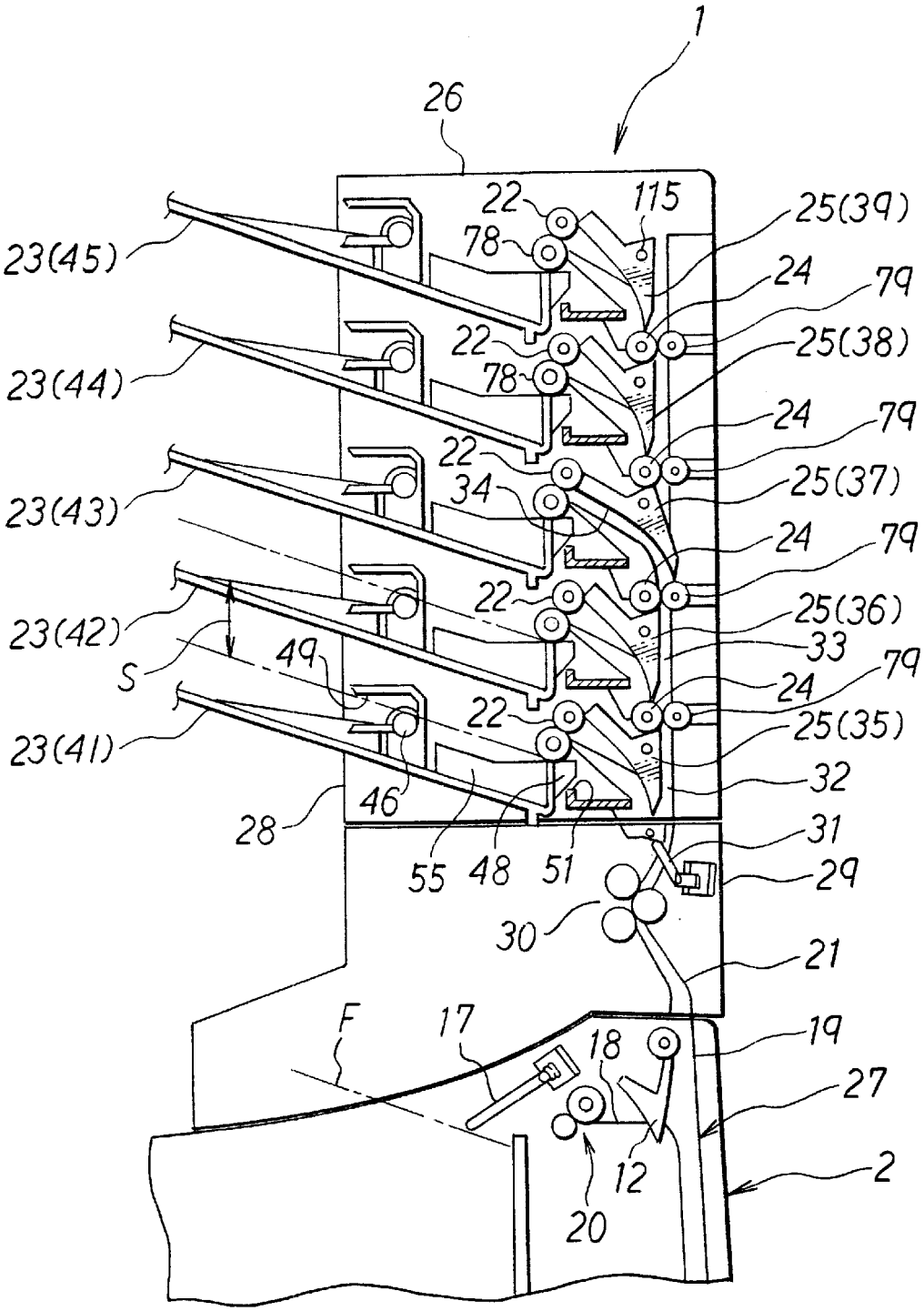
FIG. 2 shows a cross-sectional view of main components illustrating the paper sheet discharge apparatus shown in FIG. 2 in a magnified manner.

The paper sheet discharge apparatus 1 is detachably attached to the upper portion of the laser printer 2 constructed as described above. FIG. 2 shows a cross-sectional view of main components illustrating the paper sheet discharge apparatus 1 shown in FIG. 1 in a magnified manner.

Next, the paper sheet discharge apparatus 1 will be explained with reference to FIG. 2. As shown in FIG. 2, the paper sheet discharge apparatus 1 comprises, in its casing 26, an introducing passage 21 as the introducing section for receiving the paper sheet on which a predetermined image is formed by the image-forming apparatus 2, a plurality of delivery rollers 22 as discharge means for discharging the paper sheet, a plurality of bins 23 as storing units provided corresponding to the respective delivery rollers 22, for storing the paper sheets discharged from the respective delivery rollers 22, transport rollers 24 as transport means for transporting the paper sheet received from the introducing passage 21 to the respective delivery rollers 22, and a plurality of switching flappers 25 as switching means for switching the transport direction in order to transport the paper sheet received from the introducing passage 21 to the specified delivery rollers 22.

The casing 26 is formed such that it is dividable into an upper casing 28 which is provided with the delivery rollers 22, the plurality of bins 23, the transport rollers 24, the switching flappers 25, and other components, and a lower casing 29 which is provided with the introducing passage 21. The lower casing 29 is detachably attached to the upper portion of the laser printer 2, and the introducing passage 21 is connected to the introducing passage-side guide passage 19 of the discharge unit 27.

The lower casing 29 is formed with the introducing passage 21 which penetrates through the lower casing 29 in the vertical direction for feeding the paper sheets discharged by the discharge roller 15 of the laser printer 2 toward the upper casing 28. The lower casing 29 is provided with an uncurling roller 30 for removing warpage of the paper sheet at an intermediate position of the introducing passage 21, and a count lever 31 for detecting the passage of the paper sheet at a downstream position from the uncurling roller 30. The lower casing 29 further comprises a selector flapper 12 as a selective discharge means which protrudes downwardly from the lower casing 29 and which is inserted into the discharge unit 27 of the laser printer 2 when the lower casing 29 is attached to the upper portion of the laser printer 2. The selector flapper 12 switches the discharge direction to determine whether the paper sheet fed by the discharge roller 15 is discharged toward the discharge tray 16 or the paper sheet is discharged toward the introducing passage 21. The selector flapper 12 is provided to be swingable between a discharge tray-side guide position (position indicated by phantom lines in FIG. 1) to guide the paper sheet toward the discharge tray 16 and an introducing passage-side guide position (position indicated by solid lines in FIG. 1) to guide the paper sheet toward the introducing passage 21. The paper sheet, which is fed by the discharge roller 15, is selectively fed to the discharge tray-side guide passage 18 or the introducing passage-side guide passage 19 in accordance with the swinging action of the selector flapper 12. The selector flapper 12 is operated by a selector flapper-operating solenoid 77 as described later on (see FIG. 10). When the selector flapper 12 as described above is provided on the side of the paper sheet discharge apparatus 1, it is possible to simplify the apparatus construction of the laser printer 2, because all of the members for determining the discharge direction of the paper sheet can be arranged on the side of the paper sheet discharge apparatus 1. Alternatively, the selector flapper 12 may be provided on the side of the laser printer 2, not on the side of the paper sheet discharge apparatus 1. In this arrangement, it is possible to simplify the apparatus construction on the side of the paper sheet discharge apparatus 1.

The upper casing 28 has a box-shaped configuration with its one open side. A plurality of bins 23 for storing the paper sheets are arranged in a vertically aligned state on the open side. The plurality of bins 23 are arranged in a state of being successively aligned in an order of the fist bin 41, the second bin 42, the third bin 43, the fourth bin 44, and the fifth bin 45 from the lowermost position to the uppermost position.

The delivery rollers 22 are provided respectively at rearward ends of the respective bins 23. The respective delivery rollers 22 are provided as pairs. One of the pair of delivery rollers 22 is driven, and the other follows it. A transport passage 32 is formed in the upper casing 28. One end of the transport passage 32 is connected to the introducing passage 21 of the lower casing 29, and the other end thereof faces the respective delivery rollers 22. The transport passage 32 includes a vertically directed transport passage 33 formed in the vertical direction through the upper casing 28, and a plurality of delivery transport passage 34 branched from the vertically directed transport passage 33 toward the respective delivery rollers 22. The transport passage 32 makes it possible to guide the paper sheets received by the introducing passage 21 to the respective delivery rollers 22.

Switching flappers 25 corresponding to the respective delivery rollers 22 are provided respectively at positions at which the vertically directed transport passage 33 is branched to the respective delivery transport passages 34 (in the following description, when it is intended to distinguish the switching flappers 25 corresponding to the first to fifth bins 41 to 45 respectively from each other, they are referred to as first to fifth flappers 35 to 39 respectively). The switching flapper 25 is swingably supported by a support point of a flapper shaft 115 formed integrally with the switching flapper 25 between a vertically directed guide position (position indicated by the switching flappers 25 other than the third switching flapper 37 in FIG. 2) for guiding the paper sheet in the vertical direction and a delivery-directed guide position (position indicated by the third switching flapper 37 in FIG. 2) for guiding the paper sheet to the corresponding delivery rollers 22. The paper sheet, which has been introduced into the upper casing 28, is guided through the vertically directed transport passage 33 to the arbitrary delivery transport passage 34 in accordance with the swinging action of the switching flapper 25.

The transport rollers 24 for transporting the paper sheets in the vertical direction are provided between the respective switching flappers 25 in the vertically directed transport passage 33. The respective transport rollers 24 are provided as pairs. One of the pair of transport rollers 24 is driven, and the other follows it.

The paper sheets, which are discharged from the laser printer 2, are stored in the respective bins 23 as follows in the paper sheet discharge apparatus 1 constructed as described above.

That is, when the selector flapper 12 is switched to be at the introducing passage-side guide position (position indicated by the solid lines in FIG. 1) in the discharge unit 27 of the laser printer 2, the paper sheet, on which the predetermined image is formed, is received from the discharge roller 15 through the selector flapper 12 to the introducing passage 21 formed in the lower casing 29 of the paper sheet discharge apparatus 1. The warpage of the paper sheet received by the introducing passage 21 is removed by the uncurling roller 30. After that, the paper sheet pushes and moves the count lever 31, and it is introduced into the transport passage 32 on the side of the upper casing 28. When the count lever 31 is pushed and moved, then the detection signal is outputted, and the presence or absence of advance of the paper sheet into the paper sheet discharge apparatus 1 is judged by CPU 40 as described later on.

The paper sheet, which has been introduced into the transport passage 32, is transported through the vertically directed transport passage 33 in accordance with the rotational driving of the transport rollers 24. When the paper sheet arrives at the switching flapper 25 located at the delivery-directed guide position, then the paper sheet is guided by the switching flapper 25, and it is guided to the delivery rollers 22 corresponding to the switching flapper 25. This process will be described in further detail below. The first to fifth flappers 35 to 39 are controlled by CPU 40 described later on (see FIG. 10). Accordingly, only the specified switching flapper 25, which is directed to the delivery rollers 22 corresponding to the bin 23 in which it is intended to store the paper sheet, is located at the delivery-directed guide position. The other switching flappers 25 are located at the vertically directed guide position. The switching flapper 25 is switched by operating a switching flapper-operating solenoid 64 shown in FIGS. 3 and 10 as described later on.

FIG. 2 is illustrative of the case to store the paper sheets in the third bin 43, in which the first, second, fourth, and fifth flappers 35, 36, 38, 39 other than the third flapper 37 are located at the vertically directed guide position, while only the third flapper 37 is located at the delivery-directed guide position. In the illustrative case shown in FIG. 2, when the paper sheet is introduced into the transport passage 21, the paper sheet is fed upwardly through the vertically directed transport passage 33 by the aid of the transport rollers 24, because the first and second switching flappers 35, 36 are located at the vertically directed guide position. When the paper sheet arrives at the third flapper 37 located at the delivery-directed guide position, then the transport direction is switched into the direction directed to the delivery transport passage 34, and the paper sheet is fed to the delivery rollers 22 corresponding to the third bin 43. The paper sheet is discharged by the delivery rollers 22, and it is stored in the third bin 43. All of the delivery rollers 22 and the transport rollers 24 are driven by a motor 65 shown in FIG. 3 by the aid of driving shafts 80 and an unillustrated gear array.

According to the apparatus constructed as described above, the paper sheet, which is received from the introducing passage 21, is transported through the vertically directed transport passage 33 by the aid of the transport rollers 24 without decreasing its speed until the paper sheet arrives at the specified switching flapper 25. After the transport direction is switched by the specified switching flapper 25, the paper sheet is discharged by the delivery rollers 22 without decreasing its speed toward the bin 23 corresponding to the delivery rollers 22 until the frontward end and the rearward end of the paper sheet are completely discharged. Therefore, the paper sheet, on which the image is formed by the laser printer 2, is sorted and accommodated reliably at a high speed.

In the paper sheet discharge apparatus 1, the plurality of bins 23 are detachably attached to the upper casing 28.

Figure 4:
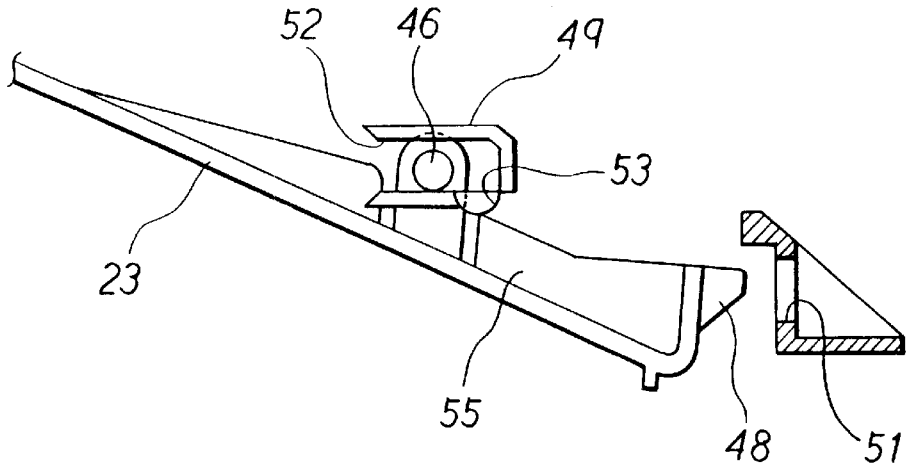
FIG. 4 illustrates an attachment/detachment state of the bin shown in FIG. 2.
Figure 5:
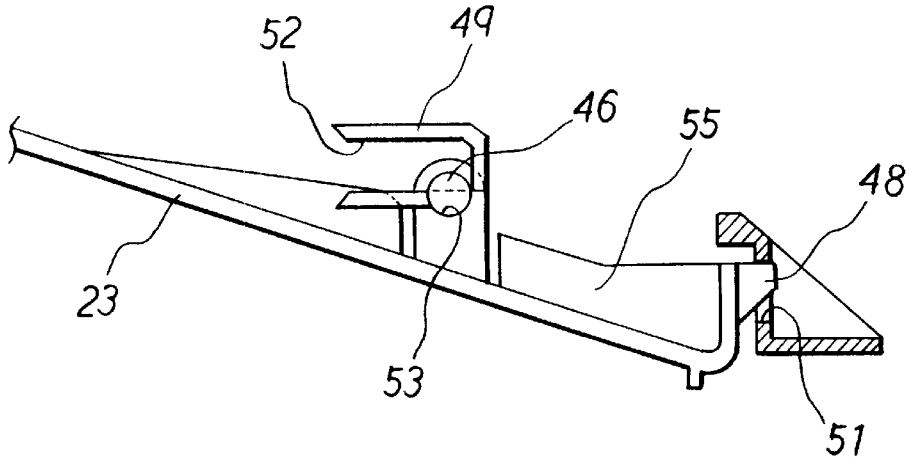
FIG. 5 illustrates an attachment/detachment state of the bin shown in FIG. 2.
Figure 6:
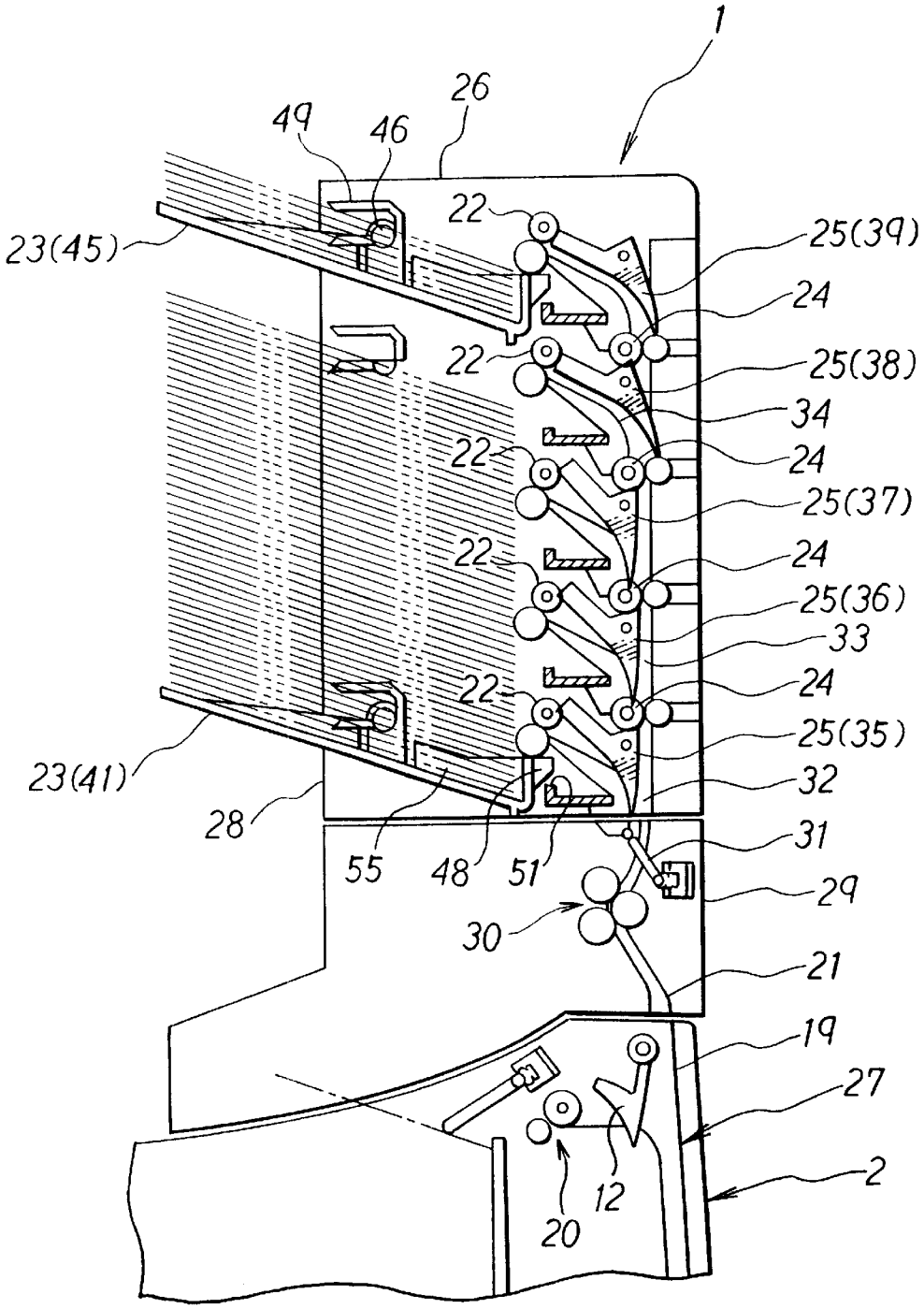
FIG. 6 shows a cross-sectional view of main components corresponding to FIG. 2, illustrating a state in which the second to fourth bins are removed.

FIG. 3 shows a cross-sectional top view of main components in which one of the bins 23 is viewed from an upper position. FIGS. 4 and 5 illustrate attachment/detachment states of the bin 23. FIG. 6 shows a cross-sectional view of main components corresponding to FIG. 2, illustrating a state in which the second to fourth bins 42 to 44 are removed. The attachment and the detachment of the bin 23 will be explained with reference to FIGS. 3 to 6.

Each of the bins 23 is provided with a receiving tray section 54 for receiving the paper sheets as shown in FIG. 3, and guide sections 55, 56 which rise perpendicularly from both widthwise ends of the receiving tray section 54 as shown in FIGS. 4 and 5 respectively. The both guide sections 55, 56 are formed with columnar side projections 46, 47 which protrude in the widthwise direction respectively. Rear projections 48 are formed at their rearward ends to protrude in the rearward direction. On the other hand, as shown in FIG. 3, side receiving grooves 49, 50, which are opposed to the side projections 46, 47, are formed on the upper casing 28. As shown in FIGS. 4 and 5, rear receiving holes 51, which are opposed to the rear projections 48, are formed on the upper casing 28. Each of the side receiving grooves 49, 50 has a long groove section 52 which extends in the longitudinal direction, and an arc-shaped fastening section 53 which are disposed at a rearward lower portion of the long groove section 52 for fixing the side projection 46, 47.

When the bin 23 is installed to the upper casing 28, the side projections 46, 47 are inserted through openings of the long groove sections 52 as shown in FIG. 4. The side projections 46, 47 are allowed to fall into the fastening sections 53 as shown in FIG. 5, simultaneously with which the rear projections 48 are inserted into the rear receiving holes 51. By doing so, the bin 23 is rotated counterclockwise as shown in FIG. 5 by its own weight about the center of the projections 46, 47, and upper portions of the rear projections 48 are fastened to upper portions of the rear receiving holes 51. Thus, the bin 23 is fixed. When the bin 23 is removed, a process reverse to the above may be performed. That is, the side projections 46, 47 are successfully drawn through the openings of the long groove sections 52. When the respective bins 23 are detachably attached as described above, the following advantage is obtained. That is, for example, the respective bins 23 are installed during the ordinary use, and they can be used for the sorting process (state shown in FIG. 2). Further, when it is intended to stack a large number of paper sheets, an arbitrary bin 23 or arbitrary bins 23 may be removed. Thus, the space, which is formed by removing the bin or bins (as indicated by S in FIG. 2), can be used as a space for storing the paper sheets, making it possible to use the space as a stacker for storing a larger amount of paper sheets. FIG. 6 is illustrative of an embodiment of the use as a stacker as described above. In FIG. 6, only the first bin 41 and the fifth bin 45 are installed, and the second to fourth bins 42 to 44 are removed. FIG. 6 shows a state in which a larger amount of paper sheets are stacked on the first bin 41 to such an extent that the second to fourth bins 42 to 44 are eliminated.

Figure 7:
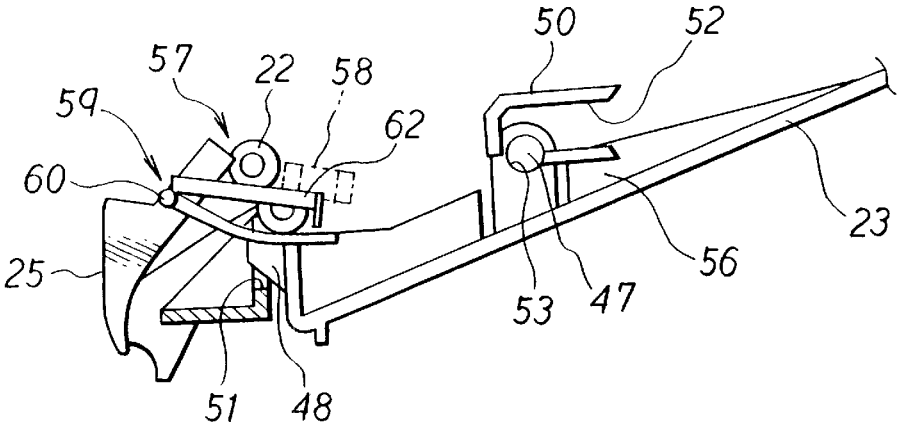
FIG. 7 illustrates an operation state of a bin level sensor.
Figure 8:
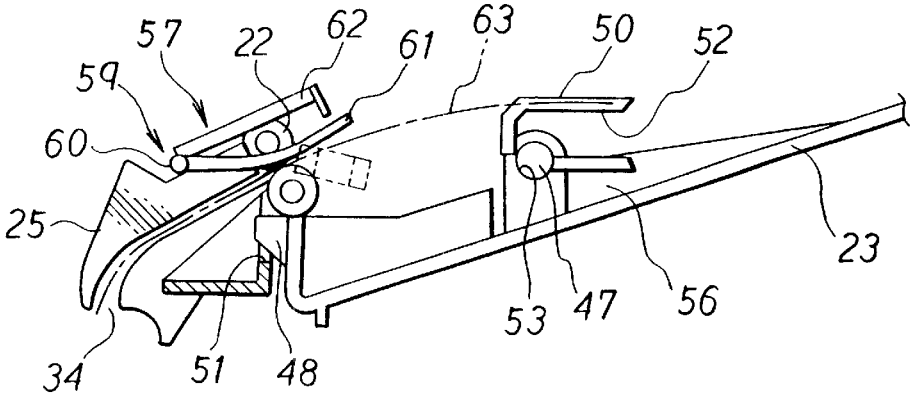
FIG. 8 illustrates an operation state of the bin, level sensor.
Figure 9:
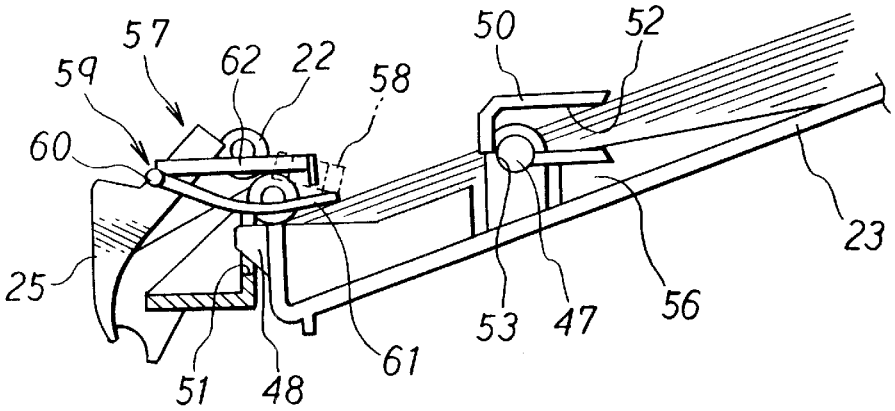
FIG. 9 illustrates an operation state of the bin level sensor.

Each of the bins 23 is provided with a bin level sensor 57 as a storage amount-detecting means for detecting the fact that each of the bins 23 is filled with stored paper sheets, i.e., the full level. FIGS. 7 to 9 illustrate operation states of the bin level sensor 57. The operation of the bin level sensor 57 will be explained with reference to FIG. 3 and FIGS. 7 to 9.

With reference to FIG. 3, the bin level sensor 57 comprises an optical sensor 58 formed to have a ]-shaped (angular U-shaped) cross section and having, at the inside of the ]-shaped configuration, a light-emitting section and a light-receiving section, and a swingable lever 59 for allowing the light for the optical sensor 58 to pass through or to be shut off depending on the stacked amount of the paper sheets. The swingable lever 59 comprises a pivot shaft 60 which is rotatably supported at a rearward portion of the bin 23, a paper sheet-abutting lever 61 which extends from one end of the pivot shaft 60 to the receiving tray section 54 of the bin 23 and which abuts against the uppermost paper sheet stored in the receiving tray section 54, and an optical sensor-entering lever 62 which extends from the other end of the pivot shaft 60 to the inside of the ]-shaped configuration of the optical sensor 58, for allowing the light directed from the light-emitting section to the light-receiving section to pass through or to be shut off.

When no paper sheet is stored in the bin 23, the paper sheet-abutting lever 61 is in a state of being lowered to the lowermost position by its own weight as shown in FIG. 7. Corresponding thereto, the optical sensor-entering lever 62 is held at a position under the optical sensor 58. When the paper sheet is discharged by the delivery rollers 22 to the bin 23 as shown in FIG. 8, the paper sheet-abutting lever 61 is flipped by the discharged paper sheet (indicated by a phantom line 63 in FIG. 8), and it is held at a position over the optical sensor 58 corresponding thereto. When the paper sheet is fully discharged, the paper sheet-abutting lever 61 is restored again to the state shown in FIG. 7. The vertical swinging movement of the swingable lever 59 as described above is repeated until the bin 23 is filled with the discharged paper sheets. When the paper sheet-abutting lever 61 is flipped, and when it is restored from the flipped position to the state shown in FIG. 7, then the optical sensor-entering lever 62 instantaneously shuts off the optical sensor 58 corresponding thereto. However, the control is made by CPU described later on so that the instantaneous period of time is judged such that the optical sensor 58 does not detect the full level. When the bin 23 is filled with the discharged paper sheets, the paper sheet-abutting lever 61 abuts against the uppermost paper sheet of the paper sheets which fill the bin 23 as shown in FIG. 9. Corresponding thereto, the optical sensor-entering lever 62 is held at the inside of the ]-shaped configuration of the optical sensor 58. In this situation, the light, which is radiated from the light-emitting section to the light-receiving section of the optical sensor 58, is continuously shut off by the optical sensor-entering lever 62. This situation provides a detection signal which indicates the fact that the bin 23 is filled with the paper sheets, i.e., the full level signal to be outputted to CPU 40 as described later on.

The paper sheet discharge apparatus 1 according to the embodiment of the present invention, which is provided with the bin level sensor 57 for the respective bins 23, is controlled as follows. That is, if the bin level sensor 57 detects the fact that the specified bin 23 is filled with the discharged paper sheets, the switching flapper 25 is switched so that the paper sheets are transported to another bin 23 for which the full level is not detected.

Figure 10:
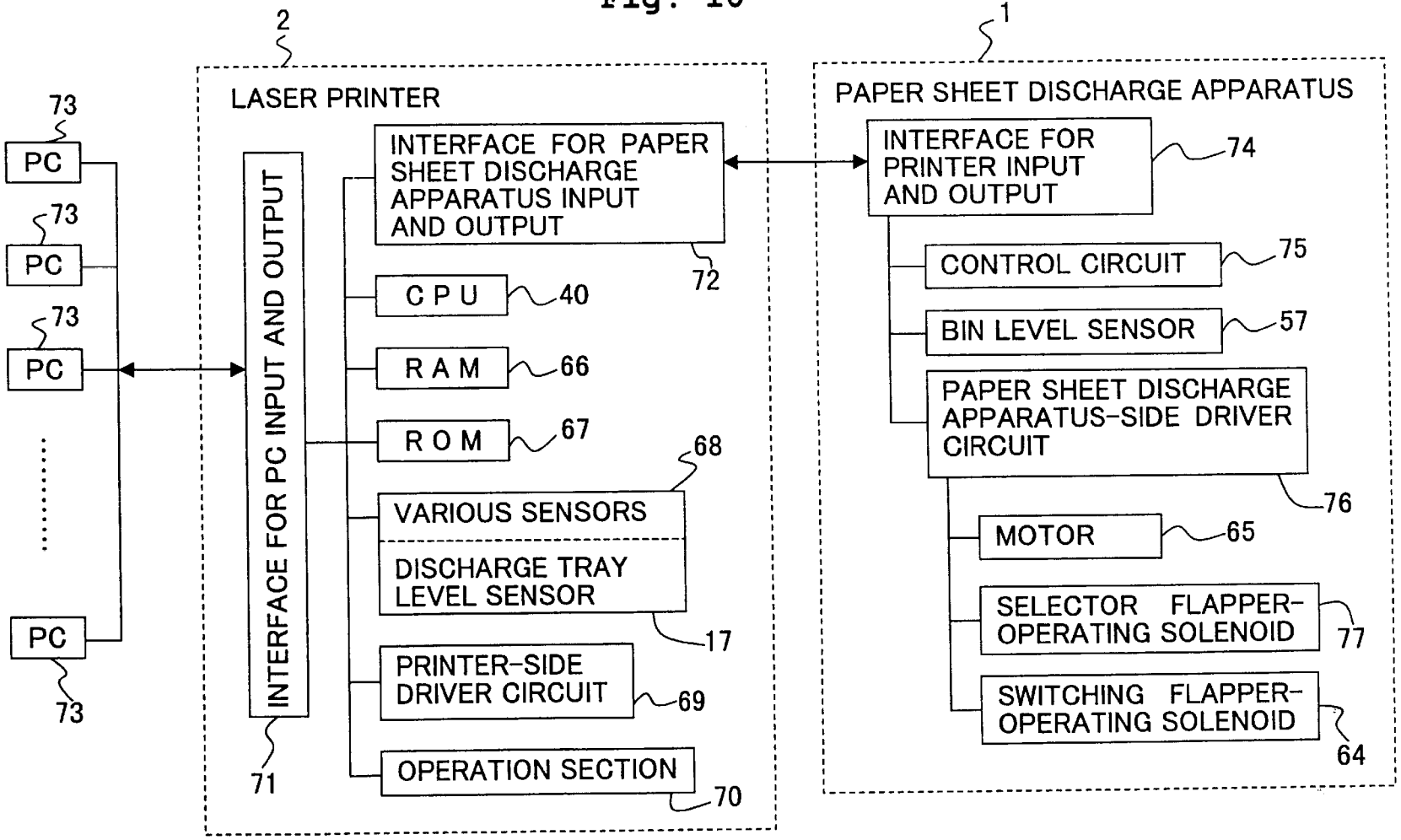
FIG. 10 shows a block diagram illustrating control systems of the laser printer and the paper sheet discharge apparatus.

FIG. 10 shows a block diagram illustrating control systems for performing the control as described above. At first, explanation will be made with reference to FIG. 10 for the control systems of the paper sheet discharge apparatus 1 and the laser printer 2.

Those connected in the control system of the laser printer 2 include respective sections of CPU 40, RAM 66, ROM 67, various sensors 68, a printer-side driver circuit 69, an operation section 70, an interface 71 for PC input and output, and an interface 72 for paper sheet discharge apparatus input and output. RAM 66 is a memory for temporary storage, and it stores, for example, received data inputted from an external personal computer (hereinafter referred to as "PC") 73 via the interface 71 for PC input and output, and bitmap data prepared in accordance with the received data. ROM 67 stores various execution programs, and it stores, for example, a conversion program for converting the received data stored in RAM 66 into the bitmap data, a selective discharge control program, a discharge control program, and a sequential discharge control program as described later on. The various sensors include the counter lever 31 and the discharge tray level sensor 17 as described above. The printer side-driver circuit 69 drives and controls electrically driven members of the laser printer 2 such as the motor for driving the various rollers, the laser scanner 133, the image-forming unit 4, and the fixing unit 5 in accordance with the instruction given by CPU 40. The operation section 70 is provided with various input switches and the like.

On the other hand, those connected to an interface 74 for printer input and output in the control system of the paper sheet discharge apparatus 1 include a control circuit 75, the bin level sensors 57 provided for the respective bins 23, and a paper sheet discharge apparatus-side driver circuit 76. The control circuit 75 controls the paper sheet discharge apparatus-side driver circuit 76 in accordance with the instruction supplied from CPU 40 of the laser printer 2 via the interface 74 for printer input and output and the interface 72 for paper sheet discharge apparatus input and output, and it transmits the detection state of the bin level sensor 57 to CPU 40 of the laser printer 2. The paper sheet discharge apparatus-side driver circuit 76 drives electrically driven members of the paper sheet discharge apparatus 1 such as the motor 65, the selector flapper-operating solenoid 77, and the switching flapper-operating solenoid 64 in accordance with the instruction given by the control circuit 75.

Next, explanation will be made with reference to flow charts shown in FIGS. 11 to 13 for the process executed by CPU 40 by using the control systems as described above in which a predetermined image is formed on the paper sheet to be ultimately discharged in accordance with the execution programs stored in ROM 67 when the received data from the external PC 73 is received by the laser printer 2.

Figure 11:
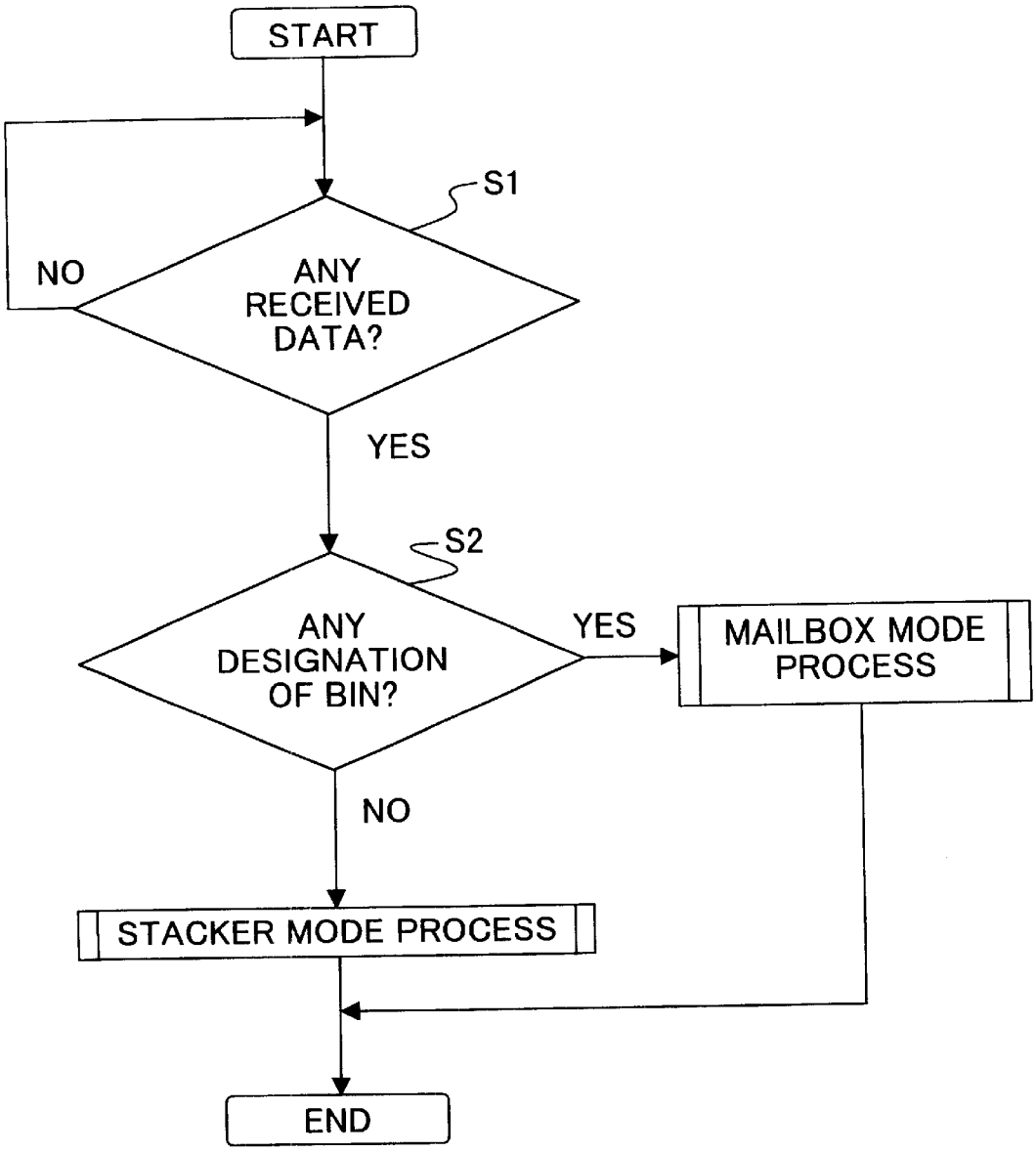
FIG. 11 shows a flow chart up to execution of the process in a mailbox mode or a stacker mode when received data is received from external PC by the laser printer.
Figure 12:
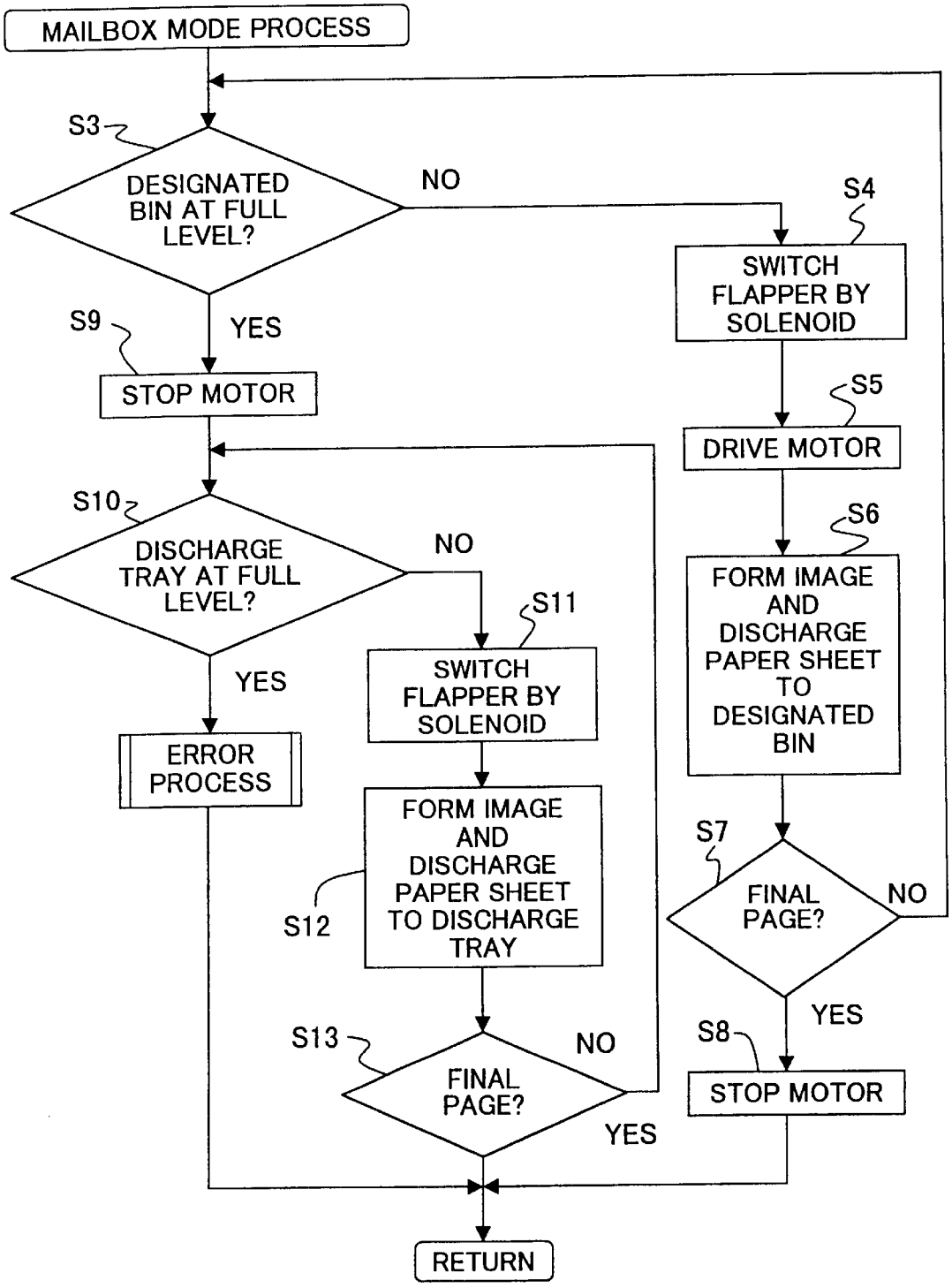
FIG. 12 shows a flow chart illustrating the process in the mailbox mode.

At first, reference is made to FIG. 11. If the received data is received in RAM 66 (S1: YES) from the external PC 73 via the interface 71 for PC input and output, it is judged whether or not there is any designation in the received data of the bin 23 for which the delivery operation is performed, i.e., there is any designation of sheet delivery to the specified bin 23 of the first to fifth bins 41 to 45 (S2). If there is the certain designation of the bin 23 (S2: YES), the system executes the mailbox mode process for using the paper sheet discharge apparatus 1 as a so-called mailbox, in which a specified person uses only allotted own bin 23 of the plurality of bins 23. If there is no designation of the specified bin 23 (S2: NO), the system executes the stacker mode process for using the paper sheet discharge apparatus 1 as a stacker in which the paper sheets formed with the predetermined image are successively stored.

Next, explanation will be made with reference to FIG. 12 for the mailbox mode process which is executed when the bin 23 to which the paper sheets are discharged is designated (S2: YES). At first, it is judged whether or not there is any detection of the full level concerning the bin level sensor 57 for the designated bin 23 (S3). If the bin level sensor 57 for the designated bin 23 does not detect the full level (S3: NO), then the selector flapper-operating solenoid 77 is firstly operated to allow the selector flapper 12 to make swinging movement to the introducing passage-side guide position so that the paper sheet may be guided from the introducing passage-side guide passage 19 into the introducing passage 21. The switching flapper-operating solenoids 64 are also operated so that only the selector flapper 25 corresponding to the designated bin 23 is allowed to make swinging movement to the delivery-directed guide position, and the other flappers 25 are allowed to make swinging movement to the vertically directed guide position (S4). Thus, a state is given, in which the paper sheet can be guided to the delivery rollers 22 corresponding to the designated bin 23. Subsequently, the motor 65 of the paper sheet discharge apparatus 1 is driven to rotate and drive the delivery rollers 22 and the transport rollers 24 (S5). The image-forming operation is executed by the laser printer 2 to discharge the paper sheet on which the predetermined image is formed. The paper sheet, which is discharged from the laser printer 2, is introduced into the paper sheet discharge apparatus 1, and it is discharged to the designated bin 23 (S6). These processes (processes ranging from S3 to S6) are repeated until images of all pages included in the received data are formed, i.e., until arrival at the final page (S7: NO). If the process for the final page is completed (S7: YES), then the driving operation of the motor 65 is stopped (S8), and the process comes to an end.

On the other hand, if the bin level sensor 57 for the designated bin 23 of the paper sheet discharge apparatus 1 detects the full level (S3: YES), the driving of the motor 65 of the paper sheet discharge apparatus 1 is stopped (S9). Then, the judgement is made for the presence or absence of the detection of the full level effected by the discharge tray level sensor 17 for detecting the full level of the discharge tray 16 of the laser printer 2 (S10). If the full level is not detected by the discharge tray level sensor 17 (S10: NO), the selector flapper-operating solenoid 77 is operated to allow the selector flapper 12 to make swinging movement to the discharge tray-side guide position so that the paper sheet is guided to the discharge tray-side guide passage 18 (S11). Subsequently, the image-forming operation is executed by the laser printer 2. The paper sheet, on which the predetermined image is formed, is discharged onto the discharge tray 16 (S12). These processes (processes ranging from S10 to S12) are repeated until arrival at the final page (S13: NO). If the process for the final page is completed (S13: YES), then the process comes to an end, and the system is in a state of waiting for the next job. If the full level is detected by the discharge tray level sensor 17 (S10: YES), it is impossible to discharge the paper sheet to both of the designated bin 23 of the paper sheet discharge apparatus 1 and the discharge tray 16 of the laser printer 2. Therefore, the image-forming operation is not executed. A predetermined error process is executed to inform the user of the fact that the paper sheet cannot be discharged.

In the embodiment of the present invention, when the designated bin 23 of the paper sheet discharge apparatus 1 is filled with the paper sheets making it impossible to store any more paper sheet, if the discharge tray 16 of the laser printer 2 is not filled with the paper sheets, then the paper sheets are continuously discharged to the discharge tray 16. Therefore, the frequency of interruption is reduced, as compared with a case in which the image-forming operation is interrupted every time when the designated bin 23 is filled with the paper sheets.

Figure 13A:
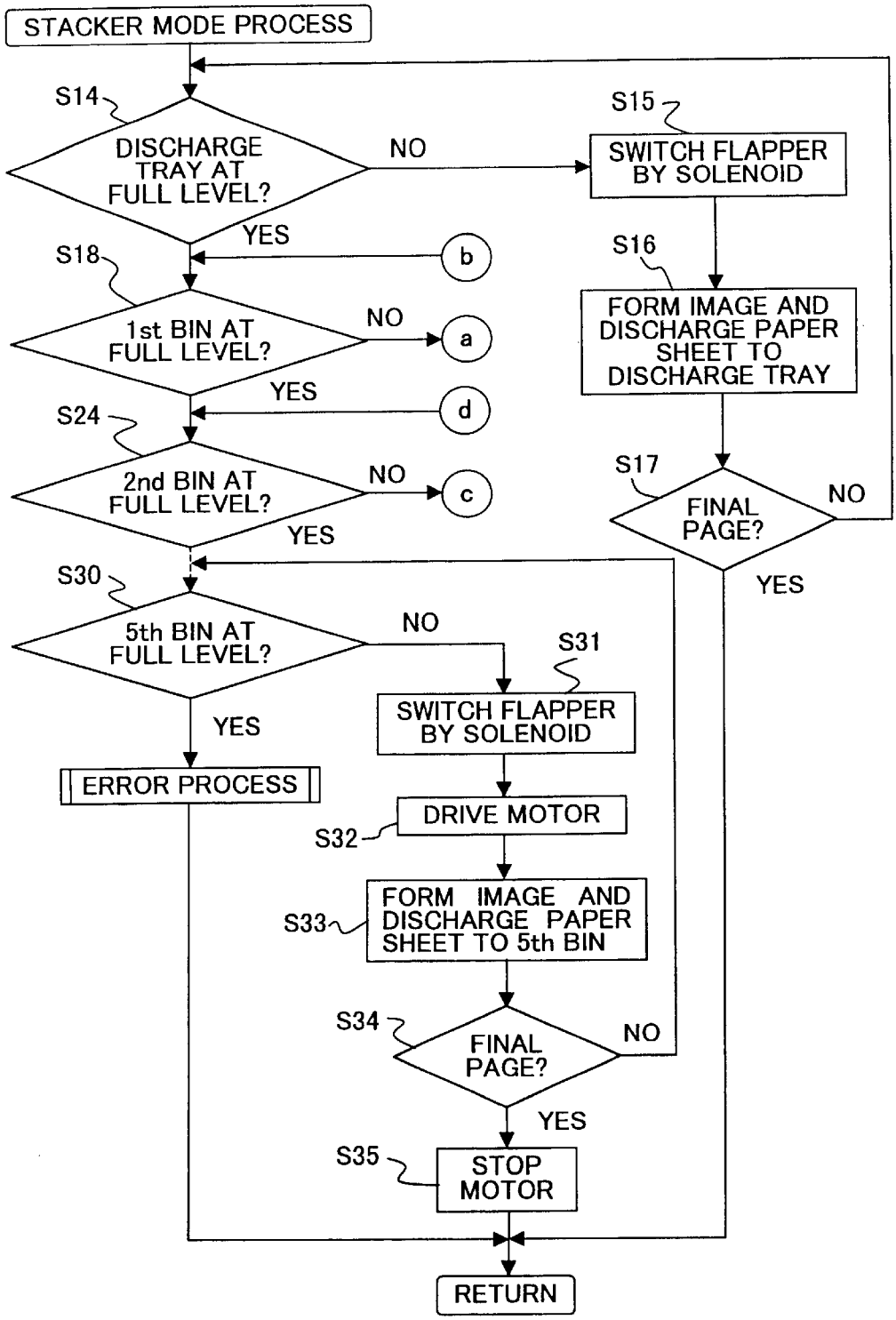
Figure 13B:
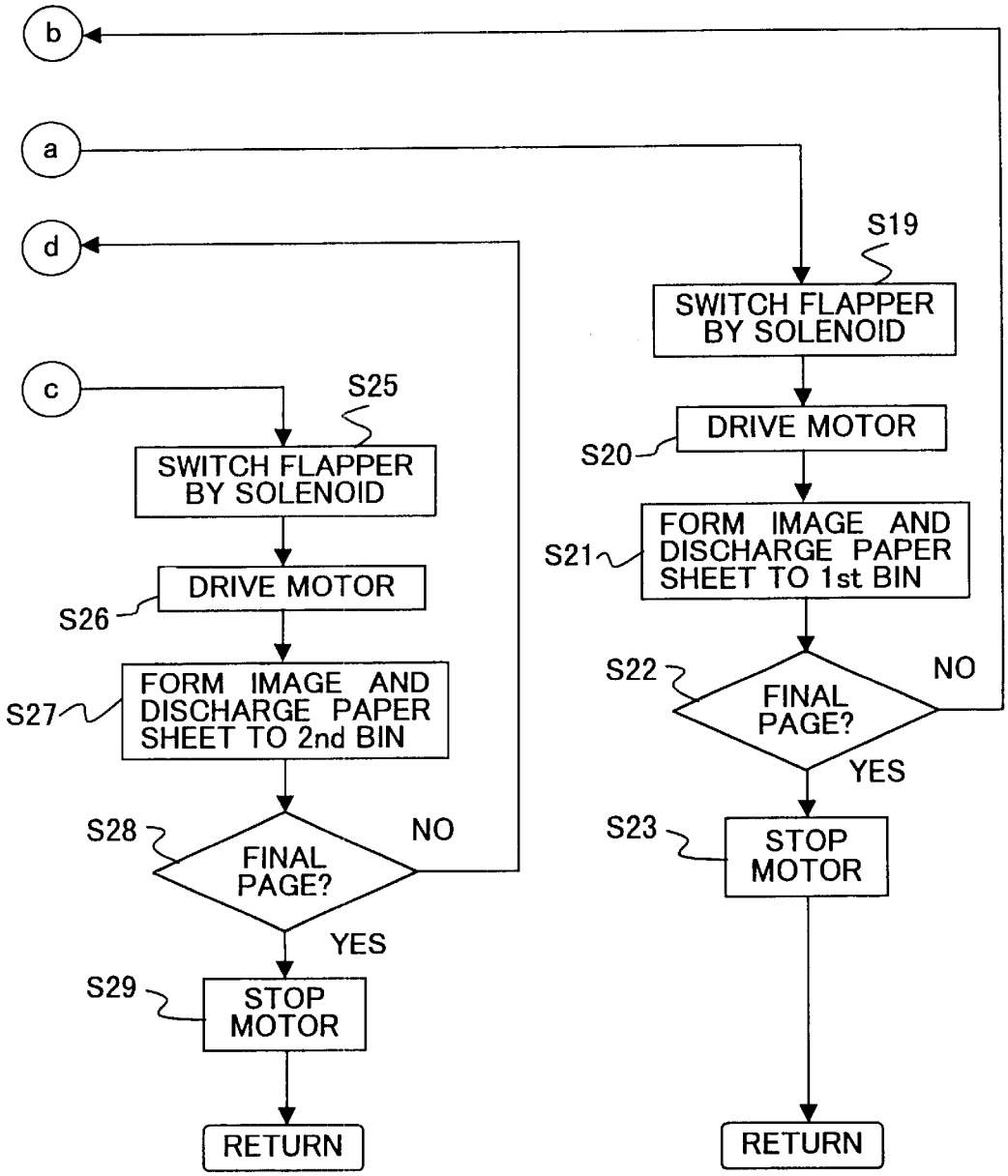

Next, the stacker mode process will be explained with reference to FIGS. 13A and 13B. This process is executed by using the selective discharge control program stored in ROM 67, the discharge control program as a discharge control means, and the sequential discharge control program as a sequential discharge control means. If the bin 23 to which the paper sheet is discharged is not designated in FIG. 11 (S2: NO), the stacker mode process shown in FIGS. 13A and B is executed. In the stacker mode process, the judgement is firstly made for the presence or absence of the detection of the full level by the discharge tray level sensor 17 for detecting the full level of the discharge tray 16 of the laser printer 2 (S14). If the full level is not detected by the discharge tray level sensor 17 (S14: NO), then the selector flapper-operating solenoid 77 is operated, and the selector flapper 12 is allowed to make swinging movement to the discharge tray-side guide position so that the paper sheet is guided to the discharge tray-side guide passage 18 (S15). Subsequently, the image-forming operation is executed by the laser printer 2. The paper sheet, on which the predetermined image is formed, is discharged onto the discharge tray 16 (S16). These processes (ranging from S14 to S16) are repeated until arrival at the final page (S17: NO). If the process for the final page is completed (S17: YES), the process comes to an end.

On the other hand, if the discharge tray level sensor 17 detects the full level (S14: YES), the paper sheet cannot be discharged to the discharge tray 16 of the laser printer 2. Therefore, it is subsequently judged whether or not the bin level sensor 57 corresponding to the first bin 41 disposed at the lowermost position of the paper sheet discharge apparatus 1 detects the full level (S18). If the bin level sensor 57 corresponding to the first bin 41 does not detect the full level (S18: NO), then the selector flapper-operating solenoid 77 is firstly operated, and the selector flapper 12 is allowed to make swinging movement to the introducing passage-side guide position so that the paper sheet may be guided from the introducing passage-side guide passage 19 into the introducing passage 21. Further, the respective switching flapper-operating solenoids 64 are operated so that only the first flapper 35 is allowed to make swinging movement to the delivery-directed guide position, and the other second to fifth flappers 36 to 39 are allowed to make swinging movement to the vertically directed guide position (S19) to give a state in which the paper sheet can be guided to the transport rollers 24 corresponding to the first bin 41. Subsequently, the motor 65 of the paper sheet discharge apparatus 1 is driven to rotate and drive the delivery rollers 22 and the transport rollers 24 (S20). The image-forming operation is executed by the laser printer 2, and the paper sheet, on which the predetermined image is formed, is discharged. The paper sheet, which is discharged from the laser printer 2, is introduced into the paper sheet discharge apparatus 1, and it is discharged to the first bin 41 (S21). These processes (ranging from S18 to S21) are repeated until arrival at the final page (S22: NO). If the process for the final page is completed (S22: YES), then the driving operation of the motor 65 is stopped (S23), and the process comes to an end.

Next, if the bin level sensor 57 corresponding to the first bin 41 of the paper sheet discharge apparatus 1 detects the full level (S18: YES), it is impossible to discharge the paper sheet to the discharge tray 16 of the laser printer 2 and the lowermost first bin 41 of the paper sheet discharge apparatus 1. Therefore, it is subsequently judged whether or not the bin level sensor 57 corresponding to the second bin 42 disposed at the second position from the bottom of the paper sheet discharge apparatus 1 detects the full level (S24). If the bin level sensor 57 corresponding to the second bin 42 does not detect the full level (S24: NO), the following operation is performed in the same manner as performed for the first bin 41. That is, the selector flapper-operating solenoid 77 is firstly operated, and the selector flapper 12 is allowed to make swinging movement to the introducing passage-side guide position so that the paper sheet may be guided from the introducing passage-side guide passage 19 into the introducing passage 21. Further, the respective switching flapper-operating solenoids 64 are operated so that only the second flapper 36 is allowed to make swinging movement to the delivery-directed guide position, and the other first to third and fifth flappers 35, 37 to 39 are allowed to make swinging movement to the vertically directed guide position (S25) to give a state in which the paper sheet can be guided to the transport rollers 24 corresponding to the second bin 42. Subsequently, the motor 64 of the paper sheet discharge apparatus 1 is driven to rotate and drive the delivery rollers 22 and the transport rollers 24 (S26). The image-forming operation is executed by the laser printer 2, and the paper sheet, on which the predetermined image is formed, is discharged. The paper sheet, which is discharged from the laser printer 2, is introduced into the paper sheet discharge apparatus 1, and it is discharged to the second bin 42 (S27). These processes (ranging from S24 to S27) are repeated until arrival at the final page (S28: NO). If the process for the final page is completed (S28: YES), then the driving operation of the motor 65 is stopped (S29), and the process comes to an end.

Next, if the bin level sensor 57 corresponding to the second bin 42 of the paper sheet discharge apparatus 1 detects the full level (S24: YES), it is subsequently judged whether or not the bin level sensor 57 corresponding to the third bin 43 disposed at the third position from the bottom detects the full level. If the bin level sensor 57 corresponding to the third bin 43 does not detect the full level, the paper sheet is discharged to the third bin 43 in accordance with the same process as performed for the first and second bins 41, 42 described above. Further, if the bin level sensor 57 corresponding to the third bin 43 detects the full level, the paper sheet is subsequently discharged to the fourth bin 44 disposed at the fourth position from the bottom. If the bin level sensor 57 corresponding to the fourth bin 44 detects the full level, it is judged whether or not the bin level sensor 57 corresponding to the uppermost fifth bin 45 detects the full level (S30). If the full level is not detected (S30: NO), the paper sheet is discharged to the fifth bin 45 (S30 to S35) in accordance with the same process as performed for the first to fourth bins 41 to 44 described above. If the bin level sensor 57 corresponding to the fifth bin 45 detects the full level (S30: YES), it is impossible to discharge the paper sheet to the discharge tray 16 of the laser printer 2 and all of the bins 41 to 45 of the paper sheet discharge apparatus 1. Therefore, the image-forming operation is not executed. A predetermined error process is executed to inform the user of the fact that the paper sheet cannot be discharged.

As described above, when the control is made in the foregoing manner in the stacker mode, the discharge tray level sensor 17 detects the full level if the discharge tray 16 is filled with the paper sheets during the process in which the paper sheet, on which the predetermined image is formed, is discharged to the discharge tray 16. The selective discharge control program is executed to automatically switch the selector flapper 12 so that the paper sheet is guided to the introducing passage 21 of the paper sheet discharge apparatus 1. Accordingly, no excessive paper sheet, which exceeds a predetermined storage amount, is stacked on the discharge tray 16. The paper sheets corresponding to the excessive amount can be successfully stored in the bin 23.

The discharge control program is executed as follows. That is, if the specified bin 23, to which the paper sheet is transported, is filled with the paper sheets, the bin level sensor 57 detects the full level. Subsequently, the switching flapper 25 is switched so that the paper sheet is transported to another bin 23 for which the bin level sensor 57 does not detect the full level, i.e., the another bin 23 which is not filled with the paper sheets. Accordingly, if the specified bin 23 is filled with the paper sheets, the paper sheet is automatically and successively transported to another bin 23 which is not filled with the paper sheets. Therefore, no excessive paper sheet, which exceeds a predetermined storage amount, is stacked on each of the bins 23. The paper sheets can be successfully stored in the respective bins 23. Further, in the embodiment of the present invention, the sequential discharge program is executed as follows. That is, the paper sheets are successively transported in the order starting from the lowermost bin 23 of the first to fifth bins 41 to 45 aligned in the vertical direction, and the paper sheets are successively stored in the respective bins 23. Therefore, the stored paper sheets are not stored in the plurality of bins 23 in a random state, but the paper sheets can be stored in a regular state. Thus, it is possible to realize efficient storage.

Further, in order to increase the paper sheet storage amount of the paper sheet discharge apparatus 1, an arbitrary bin 23 or arbitrary bins 23 disposed over the lowermost first bin 41 may be removed. Even in such a situation, the discharge destination of the paper sheet is switched depending on the detection of the full level effected by the bin level sensor 57 for each of the bins 23 starting from the delivery rollers 22 corresponding to the lowermost bin 41 and successively being changed to the delivery rollers 22 corresponding to the upper bins 23. Therefore, when the paper sheet is discharged from the respective delivery rollers 22, the falling distance of the paper sheet to the bin 23 is never increased. Thus, the paper sheets can be reliably stored in an aligned state.

The driving mechanism of the paper sheet discharge apparatus 1 will now be explained in further detail with reference to FIG. 3 and FIGS. 14 and 15. With reference to FIG. 3, the upper casing 28 has one side and the other side with respect to the bin 23 intervening therebetween. A gear box 97 to be used for driving the delivery rollers 22 and the transport rollers 24 is arranged on one side, and the switching flapper-operating solenoid 64 for driving the switching flapper 25 is arranged on the other side. The motor 65, which serves as a driving source for driving the delivery rollers 22 and the transport rollers 24, is arranged on the side on which the switching flapper-operating solenoid 64 is arranged. The motor 65 drives, via a reduction gear array 96, a roller shaft 80 of the transport rollers 24, the roller shaft 80 extending into the inside of the gear box 97 disposed on the other side.

As shown in FIG. 14, the gear box 97 accommodates a roller-driving gear array 101 as a power-transmitting means for driving the delivery rollers 22 and the transport rollers 24. The roller-driving gear array 101 comprises transport roller gears 85 which are provided at shaft ends of the roller shafts 80 of the respective transport rollers 24 (in the following description, when the transport roller gears 85 are distinguished from each other, they are referred to as first to fourth transport roller gears 87 to 90 in an order starting from the lowest one), intermediate gears 86 which are engaged with the respective transport roller gears 85 (in the following description, when the intermediate gears 86 are distinguished from each other, they are referred to as first to fifth intermediate gears 91 to 95 in an order starting from the lowest one), clutch gears 98 which are engaged with the respective intermediate gears 86, and delivery roller gears 99 which are provided at shaft ends of roller shafts 100 of the respective delivery rollers 22 and which are engaged with the respective clutch gears 98.

The power, which is inputted from the roller shaft 80 of the transport rollers 34 into the roller-driving gear array 101, is transmitted via the respective intermediate gears 86 to the respective delivery roller gears 85. The roller shafts 80 of the respective transport rollers 24 are driven, and the respective transport rollers 24 are rotated. That is, the power, which is inputted from the motor 65 into the roller shaft 80 on which the first transport roller gear 87 is provided, is transmitted via the first transport roller gear 87 to the first intermediate gear 91 and the second intermediate gear 92 which are engaged therewith at upper and lower positions respectively. The power, which is transmitted to the second intermediate gear 92, is transmitted to the second transport roller gear 88 which is engaged therewith on its upper side. Accordingly, the roller shaft 80, on which the second transport roller gear 88 is provided, is driven. The power is transmitted from the second transport roller gear 88 via the third intermediate gear 93 which is engaged therewith on its upper side to the third transport roller gear 89 which is engaged therewith on the upper side of the third intermediate gear 93. Accordingly, the roller shaft 80, on which the third transport roller gear 89 is provided, is driven. The power is transmitted from the third transport roller gear 89 via the fourth intermediate gear 94 which is engaged therewith on its upper side to the fourth transport roller gear 90 which is engaged therewith on the upper side of the fourth intermediate gear 94. Accordingly, the roller shaft 80, on which the fourth transport roller gear 90 is provided, is driven. The power is transmitted from the fourth transport roller gear 90 to the fifth intermediate gear 95 which is engaged therewith on its upper side.

On the other hand, the power is transmitted to the respective delivery rollers 22 by the aid of swinging mechanisms 118 as selective transmitting means. The swinging mechanism 118 comprises the intermediate gear 86, the clutch gear 98, the delivery roller gear 99, and a swinging arm 111 which is coupled to the clutch gear 98 at one end and which is coupled to the intermediate gear 86 at the other end. Of these components, the clutch gear 98 and the delivery roller gear 99 as a mode-switching means are subjected to engagement, or they are released from engagement. Thus, the power can be transmitted or cut off. That is, the clutch gear 98 is held on the intermediate gear 86 by the aid of the swinging arm 111. The clutch gear 98 is swingable about a support point of the shaft of the intermediate gear 86 around the intermediate gear 86 between an engaged position with respect to the delivery roller gear 99 (position indicated by the clutch gear 98 held by the third intermediate gear 93 in FIG. 14) and a released position (position indicated by the clutch gears 98 held by the intermediate gears 86 other than the third intermediate gear 93 in FIG. 14). A swinging gear section 116, which is engaged with a switching gear 117 as described later on, is formed around the side of the intermediate gear 86. The swinging action of the clutch gear 98 is interlocked with the switching action of the switching flapper 25 described below.

The switching action of the switching flapper 25 will be explained with reference to FIG. 15. In FIG. 15, each of the switching flappers 25 is provided with the switching flapper-operating solenoid 64 corresponding to each of them. The switching flapper-operating solenoid 64 is coupled to the switching flapper 25 via a link 112. Each of the switching flappers 25 is provided integrally with a spring hook 114 for fastening a spring 113. One end of the spring 113 is fastened to the upper casing 28, and the other end of the spring 113 is fastened to the spring hook 114. The switching flappers 25, which correspond to the bins 23 to which the paper sheet is not discharged, are allowed to make swinging movement about the support points of the flapper shafts 115 to the vertically directed guide positions by the aid of the action of the switching flapper-operating solenoids 64 (state indicated by the switching flappers 25 other than the third flapper 37 in FIG. 15). The switching flapper 25, which corresponds to the bin 23 to which the paper sheet is discharged, is allowed to make swinging movement to the delivery-directed guide position (state indicated by the third flapper 37 in FIG. 15) by the aid of the urging force of the spring 113 by deenergizing the action of the switching flapper-operation solenoid 64.

As described above with reference to FIG. 14, the switching gear 117, which is engaged with the swinging gear section 116 formed on the swinging arm 111, is provided integrally with the flapper shaft 115 around the flapper shaft 115 of the switching flapper 25. The engagement of the switching gear 117 with the swinging gear section 116 allows the switching action of the switching flapper 25 to be interlocked with the swinging action of the clutch gear 98. That is, when the swinging flapper 25 makes swinging movement to the vertically directed guide position in accordance with the operation of the switching flapper-operating solenoid 64, then the switching gear 117 is also rotated in accordance with the rotation of the flapper shaft 115, and the swinging arm 111, which has the swinging gear section 116 engaged with the switching gear 117, is also subjected to swinging movement. The swinging movement of the swinging arm 111 allows the clutch. gear 98 to make swinging movement in the direction to make separation from the delivery roller 99 (downward direction in FIG. 14), i.e., to the released position at which the engagement between the delivery roller gear 99 and the clutch gear 98 is released.

On the other hand, when the operation of the switching flapper-operating solenoid 64 is deenergized, and the switching flapper 25 makes swinging movement to the delivery-directed guide position by the aid of the urging force of the spring 113, then the flapper shaft 115 is rotated in a direction opposite to the direction of swinging movement of the switching flapper 25 to the vertically directed guide position. The rotation allows the swinging arm 111 to make swinging movement as well in the opposite direction (upward direction in FIG. 14) by the aid of the switching gear 117. The swinging movement of the switching arm 111 allows the clutch gear 98 to make swinging movement to the engaged position at which the clutch gear 98 is engaged with the delivery roller gear 99.

FIG. 14 shows the following state. That is, the clutch gear 98, which is held by the third intermediate gear 93, makes swinging movement to the engaged position to make engagement with the delivery roller gear 99 while being interlocked with the swinging movement of the third flapper 37 to the delivery-directed guide position. The clutch gears 98, which are held by the first, second, fourth, and fifth intermediate gears 91, 92, 94, 95 respectively, make swinging movement to the released positions to release equipment with the delivery roller gears 99 while being interlocked with the swinging movement of the first, second, fourth, and fifth switching flappers 35, 36, 38, 39 other than the third flapper 37 to the vertically directed guide positions. In this embodiment, only the delivery rollers 22 corresponding to the third flapper 37 are driven, and the other delivery rollers 22 are not driven.

According to the construction as described above, the power from the motor 65 is not transmitted to all of the delivery rollers 22. Instead, the swinging mechanism 118 can be used to selectively transmit the power to only the specified delivery rollers 22 which are used to discharge the paper sheet, of the plurality of delivery rollers 22. Accordingly, it is possible to diminish the load on the motor 65 as compared with a case in which all of the delivery rollers 22 are commonly driven. Therefore, it is unnecessary to use any expensive motor capable of outputting large power. Further, it is possible to decrease the electric power consumption required to drive the motor. Thus, it is possible to reduce the cost. Further, the number of driven members is small as compared with a case in which all of the delivery rollers 22 are always driven. Thus, it is possible to reduce the driving sound during the operation.

Further, the swinging mechanism 118 realizes the selective power transmission by using such a simple mechanism that the delivery roller gear 99 and the clutch gear 98 are subjected to engagement or they are released from engagement so that the power is transmitted to only the specified delivery rollers 22 which are used to discharge the paper sheet, and the power transmission to the other delivery rollers 22 is cut off. Furthermore, the operation is performed such that the delivery roller gear 99 and the clutch gear 98 are subjected to engagement or they are released from engagement while being interlocked with the switching action of the switching flapper 25. Therefore, it is unnecessary to provide any special equipped mechanism such as a solenoid for switching the engagement and the release from engagement between the delivery roller gear 99 and the clutch gear 98. Thus, it is possible to selectively transmit the driving power to only the delivery rollers 22 which are used to discharge the paper sheet, by using the simple mechanism.

Further, the roller-driving gear array 101 is used to transmit the power from the motor 65 to the transport rollers 24, and the swinging mechanism 118 is used to selectively transmit the power to the delivery rollers 22. Therefore, the transport rollers 22 and the delivery rollers 22 can be driven by using one motor 65.

Further, the following effect is also obtained in the case of the use as the stacker as shown in FIG. 6. With reference to FIG. 6, driven rollers 78 of the delivery rollers 22, which correspond to the removed second to fourth bins 42 to 44 respectively, contact with the stacked paper sheets. In such a situation, if all of the delivery rollers 22 are commonly driven, then the delivery rollers 22, which correspond to the driven rollers 78 contacting with the stacked paper sheets, are also driven, and the load on the motor 65 is extremely increased. Rearward ends of the paper sheets contacting with the driven rollers 78 are bent or dirtied to cause damage due to the rotation of the delivery rollers 22.

On the contrary, in the embodiment of the present invention, the switching mechanism 118 is used to selectively drive only the specified delivery rollers 22 which are used to discharge the paper sheet (for example, the delivery rollers 22 corresponding to the fifth bin 45 in FIG. 6). Accordingly, the delivery rollers 22 (for example, the delivery rollers 22 corresponding to the first to fourth bins 41 to 44 in FIG. 6), which correspond to the driven rollers 78 contacting with the stacked paper sheets, are not driven. Therefore, the load on the motor 65 is never increased by driving the delivery rollers 22 corresponding to the driven rollers 78 contacting with the paper sheets. Further, the paper sheets, which contact with the driven rollers 78, are not damaged as well.

What is claimed is:

1. A paper sheet discharge apparatus for sorting and discharging paper sheets discharged from a printing apparatus, comprising:

a casing formed with an introducing section for receiving the paper sheets;

a plurality of bins attached to the casing, for storing the sorted paper sheets respectively;

a plurality of delivery rollers for discharging, to the respective bins, the paper sheets introduced from the introducing section, each of the delivery rollers being provided in the casing corresponding to each of the bins;

a transport unit for transporting, to the plurality of delivery rollers, the paper sheets introduced from the introducing section;

a plurality of transport direction-switching units for switching a transport direction of the paper sheets introduced from the introducing section to sort the paper sheets into the plurality of bins, each of the transport direction-switching units being provided between the transport unit and one of the delivery rollers; and a power transmitting unit that includes a roller driving gear array including transport roller gears, intermediate gears engaged with respective transport roller gears, clutch gears engaged with respective intermediate gears, and discharge roller gears, the clutch gears being swingable about respective intermediate gears between an engaged position and a released position with respect to the discharge roller gears.

2. The paper sheet discharge apparatus according to claim 1, wherein the plurality of bins are detachably attached to the casing respectively.

3. The paper sheet discharge apparatus according to claim 2, further comprising:

a sensor for detecting the fact that the paper sheets stored in each of the bins have a predetermined amount in each of the bins; and a control unit for controlling the transport direction-switching unit to switch the transport direction of the paper sheet depending on a detection signal of the sensor.

4. The paper sheet discharge apparatus according to claim 3, wherein:

the plurality of bins are aligned in a predetermined direction of the casing; and the control unit switches the transport direction-switching unit so that the paper sheets are successively transported in an order of the bins aligned in their alignment direction.

5. The paper sheet discharge apparatus according to claim 1, further comprising:

a selective transmitting unit for selectively transmitting power to only a specified delivery rollers which is used to discharge the paper sheets, of the plurality of delivery rollers.

6. The paper sheet discharge apparatus according to claim 5, wherein:

the selective transmitting unit comprises a mode-switching unit for making changeover into any one of power transmission and cutoff modes with respect to respective delivery rollers; and the mode-switching unit is operated while being interlocked with a switching action of the transport direction-switching unit.

7. The paper sheet discharge apparatus according to claim 5, wherein the plurality of bins are detachably provided respectively.

8. The paper sheet discharge apparatus according to claim 5, wherein the power-transmitting unit transmits the power to the transport unit, and the selective transmitting unit selectively transmits, to the specified delivery roller, the power transmitted to the transport unit.

9. A paper sheet discharge apparatus for sorting and discharging paper sheets discharged from a printing apparatus, comprising:

an introducing section for introducing the paper sheets discharged from the printing apparatus;

a plurality of discharge means for discharging the introduced paper sheets;

a plurality of storing units provided corresponding to the respective discharge means, for storing the paper sheets discharged by the discharge means;

a transport means transporting, to the respective discharge means, the paper sheets introduced from the introducing section;

a switching means for switching a transport direction for transporting the paper sheets received from the introducing section to a specified discharge means; and a selective transmitting means for allowing the power from the driving source to be selectively transmitted to only the specified discharge means which is used to discharge the paper sheets, of the plurality of discharge means.

10. The paper sheet discharge apparatus according to claim 9, wherein at least one of the storing units is detachably provided.

11. The paper sheet discharge apparatus according to claim 9, further comprising:

a storage amount-detecting means for detecting the fact that the paper sheets to be stored in the respective storing units have a predetermined amount in the concerning storing unit; and a discharge control means for switching the switching means so that the paper sheets are transported to another storing unit for which it is not detected that the paper sheets have the predetermined amount, when the storage amount-detecting means detects the fact that the paper sheets stored in the specified storing unit have the predetermined amount in a state in which the paper sheets received from the introducing section are transported to the specified discharge means by the aid of the transport means and the switching means and they are stored in the specified storing unit.

12. The paper sheet discharge apparatus according to claim 11, wherein:

the plurality of storing units are arranged in an aligned state, and wherein the paper sheet discharge apparatus further comprises:

a sequential discharge control means for switching the switching means so that the paper sheets are successively transported in an order of the storing units aligned in their alignment direction.

13. The paper sheet discharge apparatus according to claim 9, which is used in combination with the printing apparatus, wherein the introducing section is coupled to a discharge unit of the printing apparatus.

14. A paper sheet discharge apparatus for sorting and discharging paper sheets discharged from a printing apparatus, comprising:

an introducing section for receiving the printed paper sheets;

a plurality of discharge means for discharging the received paper sheets;

a plurality of storing units provided corresponding to the respective discharge means, for storing the paper sheets discharged by the discharge means;

a transport means for transporting, to the respective discharge means, the paper sheets received from the introducing section;

a transport direction-switching means for switching a transport direction for transporting the paper sheets received from the introducing section to a specified discharge means;

a power-transmitting means for transmitting power from a driving source to the respective discharge means; and a selective transmitting means for allowing the power from the driving source to be selectively transmitted to only the specified discharge means which is used to discharge the paper sheets, of the plurality of discharge means.

15. The paper sheet discharge apparatus according to claim 14, wherein:

the selective transmitting means comprises a mode-switching means for making changeover into any one of transmission and cutoff modes of power from the driving source to the respective discharge means; and the mode-switching means is operated while being interlocked with a switching action of the transport direction-switching means.

16. The paper sheet discharge apparatus according to claim 14, wherein the respective storing units are provided detachably.

17. The paper sheet discharge apparatus according to claim 14, wherein the power-transmitting means transmits the power from the driving source to the transport means, and the selective transmitting means is capable of selectively transmitting, to the specified discharge means, the power transmitted to the transport means.

18. The paper sheet discharge apparatus according to claim 14, further comprising a control means for controlling the selective transmitting means to drive only the specified discharge means which is used to discharge the paper sheets.

19. A printing apparatus comprising:

a discharge unit for discharging printed paper sheets;

a receiving unit for receiving the paper sheets discharged from the discharge unit;

a received amount sensor for detecting the fact that the paper sheets received by the receiving unit have a predetermined amount;

a paper sheet discharge apparatus for sorting and discharging the paper sheets discharged from the discharge unit, the discharge apparatus including:

a casing connected to the discharge unit and formed with an introducing section for receiving the paper sheets discharged from the discharge unit;

a plurality of bins attached to the casing, for storing the stored paper sheets respectively;

a plurality of delivery rollers for discharging, to the respective bins, the paper sheets introduced from the introducing section, each of the delivery rollers being provided in the casing corresponding to each of the bins;

a transport unit for transporting, to the plurality of delivery rollers, the paper sheets introduced from the introducing section; and a plurality of first switching units for switching a transport direction to sort the paper sheets introduced from the introducing section into the plurality of bins, each of the first switching units being provided between the bin and one of the delivery rollers;

a second switching unit for switching a discharge direction of the paper sheets to a direction of the introducing section when the received amount sensor detects the fact that the paper sheets stored in the receiving unit have the predetermined amount; and a power transmitting unit that includes a roller driving gear array including transport roller gears, intermediate gears engaged with respective transport roller gears, clutch gears engaged with respective intermediate gears, discharge roller gears, and a swinging arm coupled to the respective clutch gears at one end and coupled to respective intermediate gears at another end such that the clutch gears are swingable about respective intermediate gears between an engaged position and a released position with respect to the discharge roller gears.

20. The printing apparatus according to claim 19, wherein the second switching unit is provided in the discharge apparatus.

21. The printing apparatus according to claim 19, wherein the plurality of bins are detachably attached to the casing respectively.

22. The printing apparatus according to claim 19, further comprising:

a sensor for detecting the fact that the paper sheets stored in each of the bins have a predetermined amount in each of the bins; and a control unit for controlling the transport direction-switching unit to switch the transport direction of the paper sheet depending on a detection signal of the sensor.

23. The printing apparatus according to claim 19, wherein:

the power transmitting unit comprises a mode-switching unit for making changeover into any one of power transmission and cutoff modes with respect to respective delivery rollers; and the mode-switching unit is operated while being interlocked with a switching action of the first switching unit.

24. The paper sheet discharge apparatus for sorting and discharging paper sheets discharged from a printing apparatus, comprising:

a casing formed with an introducing section for receiving the paper sheets;

a plurality of bins attached to the casing, for storing the sorted paper sheets respectively;

a plurality of delivery rollers for discharging, to the respective bins, the paper sheets introduced from the introducing section, each of the delivery rollers being provided in the casing corresponding to each of the bins;

a transport unit for transporting, to the plurality of delivery rollers, the paper sheets introduced from the introducing section;

a plurality of transport direction-switching units for switching a transport direction of the paper sheets introduced from the introducing section to sort the paper sheets into the plurality of bins, each of the transport direction-switching units being provided between the transport unit and one of the delivery rollers;

a sensor for detecting the fact that the paper sheets stored in each of the bins have a predetermined amount in each of the bins, the sensor being provided on the casing; and a control unit for controlling the transport direction-switching units to switch the transport direction of the paper sheet depending on a detection signal of the sensor;

wherein the plurality of bins are aligned in a vertical direction of the casing and are detachably attached to the casing respectively; and the control unit switches the transport direction-switching units so that paper sheets are successively transported in an order of the bins aligned from the lowermost bin toward the uppermost bin in the vertical direction.

25. The paper sheet discharge apparatus according to claim 25, wherein the control unit switches the transport direction-switching units regardless of detachment of any of bins.

26. The paper sheet discharge apparatus according to claim 24, further comprising:

a power transmitting unit including a roller driving gear array including transport roller gears, intermediate gears engaged with respective transport roller gears, clutch gears engaged with respective intermediate gears, and discharge rollers gears, the clutch gears being swingable about respective intermediate gears between an engaged position and a released position with respect to the discharge roller gears.

27. The paper sheet discharge apparatus according to claim 24, further comprising:

a power transmitting unit comprising a roller driving gear array including transport roller gears, intermediate gears engaged with respective transport roller gears, clutch gears engaged with respective intermediate gears, discharge roller gears, and a swinging arm coupled to respective clutch gears at one end and coupled to respective intermediate gears at another end such that the clutch gears are swingable about respective intermediate gears between an engaged position and a released position with respect to the discharge roller gears.

28. A printing apparatus comprising:

a discharge unit for discharging printed paper sheets;

a receiving unit for receiving the paper sheets discharged from the discharge unit;

a paper sheet discharge apparatus for sorting and discharging the paper sheets discharged from the discharge unit, the paper sheet discharge apparatus including:

a casing connected to the discharge unit and formed with an introduction section for receiving the paper sheet discharged from the discharge unit;

a plurality of bins attached to the casing, for storing the sorted paper sheets, respectively;

a plurality of delivery rollers for discharging, to the respective bins, the paper sheets introduced from the introducing section, each of the delivery rollers being provided in the casing corresponding to each of the bins;

a transport unit for transporting, to the plurality of delivery rollers, the paper sheets introduced from introducing section;

a plurality of first switching units for switching a transport direction to direct the paper sheets introduced from the introducing section into a specified bin, each of the transport direction-switching units being provided between the bin and one of the delivery roller; and a sensor for detecting the fact that the paper sheets stored in each of the bins have a predetermined amount in each of the bins; and a second switching unit for switching a discharge direction of the paper sheets to a direction to the receiving unit when the sensor detects the fact that the paper sheets stored in the specified bin have the predetermined amount.

29. The printing apparatus according to claim 28, wherein the second switching unit switches the discharge direction of the paper sheets to the direction to the receiving unit when the sensor detects the fact that the paper sheets stored in all of the bins have the predetermined amount.

30. The printing apparatus according to claim 28, further comprising a control unit which controls the first switching units and the second switching unit to switch the transport direction of the paper sheet depending on a detection signal of the sensor.

* * * * *

UNITED STATES PATENT AND TRADEMARK OFFICE

CERTIFICATE OF CORRECTION

PATENT NO. : 6,443,449 B1
DATED : September 3, 2002
INVENTOR(S) : Kazuhiko Takagi et al.

It is certified that error appears in the above-identified patent and that said Letters Patent is hereby corrected as shown below:

Title page,
Item [56], References Cited, U.S. PATENT DOCUMENTS,
Please insert the following line after "5,963,754 A 10/1999 Itoh et al.":
-- 5,971,384 A 10/1999 Asao --

Signed and Sealed this

Eleventh Day of February, 2003

JAMES E. ROGAN
*Director of the United States Patent and Trademark Office*